US005523203A

United States Patent [19]

Nishigaki

[11] Patent Number: 5,523,203

[45] Date of Patent: Jun. 4, 1996

[54] SILVER HALIDE PHOTOGRAPHIC MATERIAL

[75] Inventor: Junji Nishigaki, Kanagawa, Japan

[73] Assignee: Fuji Photo Film Co., Ltd., Kanagawa, Japan

[21] Appl. No.: 205,064

[22] Filed: Mar. 3, 1994

[30] Foreign Application Priority Data

Mar. 3, 1993 [JP] Japan ..... 5-065926

[51] Int. Cl.[6] ..... G03C 1/29

[52] U.S. Cl. ..... 430/574; 430/576

[58] Field of Search ..... 430/572, 574, 430/575, 576

[56] References Cited

U.S. PATENT DOCUMENTS

| | | | |
|---|---|---|---|
| 2,158,882 | 5/1939 | Mees | 430/574 |
| 2,206,076 | 7/1940 | Carroll | 430/574 |
| 3,718,475 | 2/1973 | Shiba et al. | 430/574 |
| 3,887,381 | 6/1975 | Shiba et al. | 430/574 |
| 5,236,821 | 8/1993 | Yagihara et al. | 430/601 |

FOREIGN PATENT DOCUMENTS

| | | | |
|---|---|---|---|
| 2222294 | 9/1987 | Japan | 430/574 |

*Primary Examiner*—Lee C. Wright
*Attorney, Agent, or Firm*—Sughrue, Mion, Zinn, Macpeak & Seas

[57] ABSTRACT

A silver halide photographic material spectral-sensitized with a combination of compounds represented by the following formulas (I), (II) and (III) or (IV):

(I)

(II)

(III)

(IV)

wherein $R_{11}$, $R_{12}$, $R_{21}$, $R_{22}$, $R_{31}$, $R_{32}$, $R_{41}$ and $R_{42}$ each represents an alkyl group; $R_{33}$ represents a hydrogen atom, an alkyl group or an aryl group; $Z_{11}$ and $Z_{21}$ each represents an atomic group necessary for forming a benzene ring; $Z_{12}$ represents an atomic group necessary for forming a benzthiazole or benzoselenazole nucleus; $Z_{22}$ represents an atomic group necessary for forming a benzoxazole or naphthoxazole nucleus; $Z_{31}$, $Z_{32}$ and $Z_{41}$ each represents an atomic group necessary for forming a five-membered or six-membered nitrogen-containing heterocyclic ring; $X_{11}$, $X_{21}$ and $X_{31}$ each represents a charge-neutralizing counter ion; and m, n and p each represents 0 or 1.

6 Claims, No Drawings

SILVER HALIDE PHOTOGRAPHIC MATERIAL

FIELD OF THE INVENTION

This invention relates to a silver halide Photographic material, and more particularly to a silver halide photographic material containing a silver halide photographic emulsion which has increased spectral sensitivity in the short wavelength region of green light and is excellent in storage stability.

BACKGROUND OF THE INVENTION

It is demanded to develop a method which can increase spectral sensitivity in the short wavelength region of green light and can improve the color reproducibility of photographic materials in the field of silver halide color photographic materials.

Conventional methods for increasing spectral sensitivity in the wavelength region of green light include the applications of photographic emulsions containing a combination of oxacarbocyanine and benzimidazolocarbocyanine (described in JP-A-59-116646 (the term "JP-A" as used herein means an "unexamined published Japanese patent application"), JP-A-59-116647, JP-A-59-140443 and JP-A-59-149346), a combination of oxacarbocyanine and oxathiacarbocyanine (described in JP-B-46-11627 (the term "JP-B" as used herein means an "examined Japanese patent publication") and JP-A-60-42750) and a combination of two or more oxacarbocyanines (described in JP-A-52-23931). However, spectral sensitivity in the short wavelength region of green light at 520 to 545 nm is low, and in any of these methods, it has been inconvenient to color reproducibility. Accordingly, it has been considered that sensitizing dyes having the maximum spectral sensitivity at 520 to 545 nm are further used in combination. Benzimidazolooxazolocarbocyanine (described in JP-B-44-14030) and dimethinemerocyanine (described in U.S. Pat. Nos. 2,493,743, 2,519,001 and 3,480,439) are conventionally known as sensitizing dyes having the maximum spectral sensitivity at 520 to 545 nm. However, emulsions containing benzimidazolooxazolocarbocyanine or dimethinemerocyanine have disadvantages in that fog is increased under high temperature conditions or under high temperature and humidity conditions after the coating of the emulsions, and sensitivity is lowered because of poor long-term stability after the coating of the emulsions.

There are known oxacarbocyanines, which have less inconvenience, having the maximum spectral sensitivity at 520 to 545 nm alone. Examples of the oxacarbocyanines are described in U.S. Pat. Nos. 2,521,705 and 2,521,959, 2,647,054 and JP-A-63-167348. However, the spectral sensitivity of these dyes has been still insufficient. Monomethinecyanines having 2-quinoline skeleton have the maximum spectral sensitivity at 520 to 545 nm. However, when they alone are used, sensitivity is low, and hence they are used in combination with benzimidazolocarbocyanine or oxacarbocyanine (described in JP-B-56-24939, JP-B-56-38936, JP-B-56-38940 and U.K. Patent 1,219,016). When these combinations are used, the region of-spectral sensitivity is shifted to a longer wavelength side, and hence good color reproducibility cannot be obtained. Accordingly, it has been demanded to develop a method which can increase spectral sensitivity in the short wavelength region of green light to obtain the true color reproducibility of color photographic materials.

SUMMARY OF THE INVENTION

An object of the present invention is to provide a color photographic material which has increased spectral sensitivity in the short wavelength region of green light and is excellent in long-term stability.

This and other objects of the present invention have been achieved by providing a silver halide photographic material, wherein spectral sensitization is carried out by using a combination of at least one compound represented by the following formula (I); at least one compound represented by the following formula (II); and at least one compound selected from the group consisting of compounds represented by the following formulas (III) and (IV):

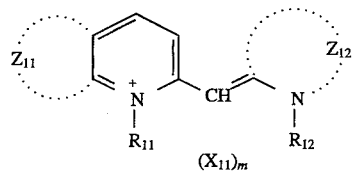

(I)

In formula (I), $R_{11}$ and $R_{12}$ are the same or different and each represents an alkyl group; $Z_{11}$ represents an atomic group necessary for forming a benzene ring; $Z_{12}$ represents an atomic group necessary for forming a benzthiazole nucleus or a benzoselenazole nucleus; $X_{11}$ represents a charge-neutralizing counter ion; and m represents 0 or 1 and when an inner salt is formed, m is 0;

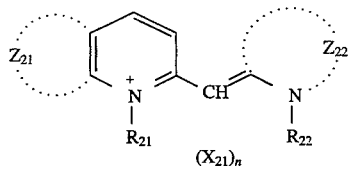

(II)

In formula (II), $R_{21}$, $R_{22}$, $Z_{21}$, $X_{21}$ and n have the same meaning as $R_{11}$, $R_{12}$, $Z_{11}$, $X_{11}$, and m in formula (I), respectively; and $Z_{22}$ represents an atomic group necessary for forming a benzoxazole nucleus or a naphthoxazole nucleus;

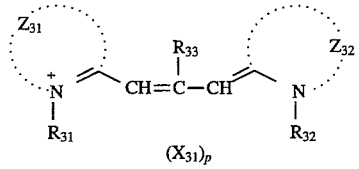

(III)

In formula (III), $R_{31}$ and $R_{32}$ have the same meaning as $R_{11}$ and $R_{12}$ in formula (I); $R_{33}$ represents a hydrogen atom, an alkyl group or an aryl group; $Z_{31}$ and $Z_{32}$ are the same or different and each represents an atomic group necessary for forming a nitrogen-containing five-membered or six-membered heterocyclic ring; and $X_{31}$ and p have the same meaning as $X_{11}$ and m in formula (I), respectively;

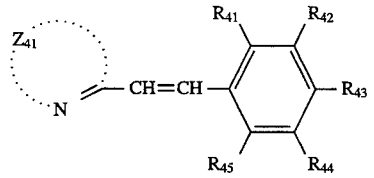

(IV)

In formula (IV), $Z_{41}$ has the same meaning as $Z_{31}$ and $Z_{32}$ in formula (III) or represents an atomic group necessary for forming a nitrogen-containing five-membered or six-membered heterocyclic ring; $R_{41}$, $R_{42}$, $R_{43}$, $R_{44}$ and $R_{45}$ are the same or different and each represents a substituted amino group, a hydrogen atom, a halogen atom, a hydroxyl group, an alkyl group, an alkoxy group or an aryl group or a group capable of forming a five-membered or six-membered ring by condensed with adjoining substituent groups.

DETAILED DESCRIPTION OF THE INVENTION

Now, the present invention will be illustrated in greater detail below.

When the above-described combination of the dyes is applied to silver halide emulsions chemical-sensitized with a selenium sensitizing agent represented by the following formula (V), more higher sensitivity can be obtained:

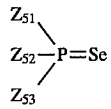

(V)

In formula (V), $Z_{51}$, $Z_{52}$ and $Z_{53}$ are the same or different and each represents an alkyl group, an aryl group, a heterocyclic group, a halogen atom, a hydrogen atom, $—OR_{51}$, $—NR_{52}(R_{53})$, $—SR_{54}$ or $—SeR_{55}$; wherein $R_{51}$, $R_{54}$ and $R_{55}$ each represents an alkyl group, an aryl group, a heterocyclic group, a hydrogen atom or a cation; and $R_{52}$ and $R_{53}$ each represents an alkyl group, an aryl group, a heterocyclic group or a hydrogen atom.

The compounds represented by formula (I) will be illustrated in greater detail below.

In formula (I), $Z_{11}$ represents an atomic group necessary for forming a benzene ring. At least one atom of the atomic group may be substituted by an alkyl group, an alkoxy group or an aryloxy group. The benzene ring formed by $Z_{11}$ is preferably a benzene ring substituted by an alkyl group at the 6-position thereof.

Examples of the alkyl group by which $Z_{11}$ may be substituted include a methyl group, an ethyl group, an n-propyl group, an isopropyl group, a t-butyl group, an n-octyl group, an n-decyl group, an n-hexadecyl group, a cyclopentyl group and a cyclohexyl group. Among these, a methyl group and an ethyl group are preferred.

Examples of the alkoxy group by which $Z_{11}$ may be substituted include a methoxy group, an ethoxy group, a propoxy group and a methylenedioxy group. Among these, a methoxy group is preferred.

Examples of the aryloxy group by which $Z_{11}$ may be substituted include a phenoxy group, a 4-methylphenoxy group and a 4-chlorophenoxy group. Among these, a phenoxy group is preferred.

In formula (I), $Z_{12}$ represents an atomic group necessary for forming a benzthiazole nucleus or a benzoselenazole nucleus. At least one atom of the atomic group may be substituted by a halogen atom, an alkyl group, an alkoxy group, an alkylthio group or an aryl group. Among these substituents, a halogen atom, an alkyl group, an alkoxy group and an aryl group are preferred. A benzthiazole nucleus and a benzoselenazole nucleus each substituted by a halogen atom or an alkyl group at the 5-position thereof are more preferred.

Examples of the halogen atom by which $Z_{12}$ may be substituted include a fluorine atom, a chlorine atom, a bromine atom and an iodine atom. Among these, a bromine atom and a chlorine atom are preferred.

The alkyl group by which $Z_{12}$ may be substituted may have a substituent, and examples of the alkyl group include a methyl group, an ethyl group, an n-propyl group, an isopropyl group, a t-butyl group, an n-butyl group, an n-octyl group, an n-decyl group, an n-hexadecyl group, a cyclopentyl group, a cyclohexyl group, a trifluoromethyl group and a hydroxyethyl group. Among these, a trifluoromethyl group is preferred.

Examples of the alkoxy group by which $Z_{12}$ may be substituted include a methoxy group, an ethoxy group, a propoxy group and a methylenedioxy group. Among these, a methoxy group is preferred.

Examples of the alkylthio group by which $Z_{12}$ may be substituted include a methylthio group, an ethylthio group and a propylthio group. Among these, a methylthio group is preferred.

Examples of the aryl group by which $Z_{12}$ may be substituted include a phenyl group, a pentafluorophenyl group, a 4-chlorophenyl group, a 3-sulfophenyl group and a 4-methylphenyl group. Among these, a phenyl group is preferred.

In formula (I), $R_{11}$ and $R_{12}$ each represents an unsubstituted alkyl group having from 1 to 18 carbon atoms (e.g., methyl, ethyl, propyl, butyl, pentyl, octyl, decyl, dodecyl, octadecyl) or a substituted alkyl group having from 1 to 18 carbon atoms substituted by one or more substituents. Examples of the substituents include a carboxyl group, a sulfo group, a cyano group, a halogen atom (e.g., fluorine, chlorine, bromine), a hydroxyl group, an alkoxycarbonyl group having from 2 to 8 carbon atoms (e.g., methoxycarbonyl, ethoxycarbonyl, benzyloxycarbonyl), an alkanesulfonylaminocarbonyl group from 2 to 8 carbon atoms, an acylaminosulfonyl group having from 1 to 8 carbon atoms, an alkoxy group having from 1 to 8 carbon atoms (e.g., methoxy, ethoxy, benzyloxy, phenethyloxy), an alkylthio group having from 1 to 8 carbon atoms (e.g., methylthio, ethylthio, methylthioethylthioethyl), an aryloxy group having from 6 to 20 carbon atoms (e.g., phenoxy, p-tolyloxy, 1-naphthoxy, 2-naphthoxy), an acyloxy group having from 1 to 3 carbon atoms (e.g., acetyloxy, propionlyloxy), an acyl group having from 1 to 8 carbon atoms (e.g., acetyl, propionyl, benzoyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl) and an aryl group having from 6 to 20 carbon atoms(e.g., phenyl, 4-chlorophenyl, 4-methylphenyl, α-naphthyl).

An unsubstituted alkyl group (e.g., methyl, ethyl, n-butyl, n-pentyl, n-hexyl), a carboxyalkyl group (e.g., 2-carboxyethyl, carboxymethyl) and a sulfoalkyl group (e.g., 2-sulfoethyl, 3-sulfoprropyl, 4-sulfobutyl, 3-sulfobutyl) are preferred as $R_{11}$ or $R_{12}$.

A sulfoethyl group, a sulfopropyl group, a sulfobutyl group, a carboxymethyl group and a carboxyethyl group are more preferred as $R_{11}$ or $R_{12}$.

In formula (I), $X_{11}$ represents a charge-neutralizing counter ion. Ion for neutralizing charge in the molecule is selected from among anions and cations. Examples of the anions include inorganic and organic acid anions (e.g., p-toluenesulfonate, p-nitrobenzenesulfonate, methanesulfonate, methylsulfonate, ethylsulfonate, perchlorate) and a halogen ion (e.g., chloride, bromide, iodide). The cations include inorganic and organic cations. Specific examples of the cations include a hydrogen ion, an alkali metal ion (e.g., lithium, sodium, potassium and cesium ions), an alkaline earth metal ion (e.g., magnesium, calcium and strontium ions) and an ammonium ion (e.g., organic ammonium, triethanol ammonium and pyridium ions).

in formula (I), m represents 0 or 1, and when an inner salt is formed, m is 0.

The compounds represented by formula (II) will be illustrated in greater detail below.

In formula (II), $R_{21}$ and $R_{22}$ have the same meaning as $R_{11}$ and $R_{12}$ in formula (I) and are preferably each a sulfoethyl group, a sulfopropyl group, a sulfobutyl group, a carboxymethyl group or a carboxyethyl group.

In formula (II), $Z_{21}$ has the same meaning as $Z_{11}$ in formula (I), and $X_{21}$ and n have the same meaning as $X_{11}$ and m in formula (I), respectively.

In formula (II), $Z_{22}$ represents an atomic group necessary for forming a benzoxazole nucleus or a naphthoxazole nucleus. At least one atom of the atomic group may be substituted by a halogen atom, an aklyl group, an alkoxy group, an alkylthio group or an aryl group. Among these substituents, a halogen atom, an alkyl group, an alkoxy group and an aryl group are preferred. A benzoxazole nucleus substituted by a halogen atom or an aryl group at the 5-position thereof is more preferred.

Examples of the halogen atom by which $Z_{22}$ may be substituted include a fluorine atom, a chlorine atom, a bromine atom and an iodine atom. Among these, a bromine atom and a chlorine atom are preferred.

The alkyl group by which $Z_{22}$may be substituted may have a substituent, and examples of the alkyl group include a methyl group, an ethyl group, an n-propyl group, an isopropyl group, a t-butyl group, an n-butyl group, an n-octyl group, an n-decyl group, an n-hexadecyl group, a cyclopentyl group, a cyclohexyl group, a trifluoromethyl group and a hydroxyethyl group. Among these, a trifluoromethyl group is preferred.

Examples of the alkoxy group by which $Z_{22}$ may be substituted include a methoxy group, an ethoxy group, a propoxy group and a methylenedioxy group. Among these, a methoxy group is preferred.

Examples of the alkylthio group by which $Z_{22}$ may be substituted include a methylthio group, an ethylthio group and a propylthio group. Among these, a methylthio group is preferred.

Examples of the aryl group by which $Z_{22}$ may be substituted include a phenyl group, a pentafluorophenyl group, a 4-chlorophenyl group, a 3-sulfophenyl group and a 4-methylphenyl group. Among these, a phenyl group is preferred.

The compounds represented by formula (III) will be illustrated in greater detail below.

Examples of the nucleus formed by $Z_{31}$ and $Z_{32}$ include thiazole nuclei (for example, thiazole nuclei (e.g., thiazole, 4-methylthiazole, 4-phenylthioazole, 4,5-dimethylthiazole, 4,5-diphenylthiazole, 3,4-dihydronaphtho[4,5-a]thiazole), benzthiazole nuclei (e.g., benzthiazole, 4-chlorobenzthiazole, 5-chlorobenzthiazole, 6-chlorobenzthiazole, 5-nitrobenzthiazole 4-methylbenzthiazole, 5-methylbenzthiazole, 6-methylbenzthiazole, 5-bromobenzthiazole, 6-bromobenzthiazole, 5-iodobenzthiazole, 5-phenylbenzthiazole, 5-phenylbenzthiazole, 5-methoxybenzthiazole, 6-methoxybenzthiazole, 5-ethoxybenzthiazole, 5-ethoxycarbonylbenzthiazole, 5-phenoxybenzthiazole, 5-carboxybenzthiazole, 5-acetylbenzthiazole, 5-acetoxybenzthiazole, 5-phenethylbenzthiazole, 5-fluorobenzthiazole, 5-trifluoromethylbenzthiazole, 5-chloro-6-methylbenzthiazole, 5,6-dimethylbenzthiazole, 5,6-di-methoxybenzthiazole, 5,6-methylenedioxybenzthiazole, 5-hydroxy-6-methylbenzthiazole, tetrahydrobenzthiazole, 4-phenylbenzthiazole, 5,6-bismethylthiobenzthiazole), naphthothiazole nuclei (e.g., naphtho[2,1-d]thiazole, naphtho[1,2-d]thiazole, naphtho[2,3-d]thiazole, 5-methoxynaphto[1,2-d]thiazole, 7-ethoxynaphtho-[2,1-d]thiazole, 8-methoxynaphtho[2,1-d]thiazole, 5-methoxynaphtho[2,3-d]thiazole, 8-methylthionaphtho-[2,1-d]thiazole); thiazoline nuclei (for example, thiazoline, 4-methylthiazoline, 4-nitrothiazoline); oxazole nuclei (for example, oxazole nuclei (e.g., oxazole, 4-methyloxazole, 4-nitrooxazole, 5-methyloxazole, 4-phenyloxazole, 4,5-diphneyloxazole, 4-ethyloxazole), benzoxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, 5-acetylbenzoxazole), naphthoxazole nuclei (e.g., naphtho[2,1-d]oxazole, naphtho[1,2-d]oxazole, naphtho[2,3-d]oxazole, 5-nitro-naphtho[2,1-d ]oxazole)); oxazoline nuclei (for example, 4,4-dimethyloxazoline); selenazole nuclei (for example, selenazole nuclei (e.g., 4-methylselenazole, 4-nitroselenazole, 4-phenylselenazole), benzoselenazole nuclei (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), naphthoselenazole nuclei (e.g., naphtho[2,1-d]selenazole, naphtho[1,2-d]selenazole)); selenazoline nuclei (for example, selenazoline, 4-methylselenazoline); tellurazole nuclei (for example, tellurazole nuclei (e.g., tellurazole, 4-methyltellurazole, 4-phenyltellurazole), benzotellurazole nuclei (e.g., benzotellurazole, 5-chlorobenzotellurazole, 5-methylbenzotellurazole, 5,6-dimethylbenzotellurazole, 6-methoxybenzotellurazole), naphthotellurazole nuclei (e.g., naphtho[2,1-d]tellurazole, naphtho[1,2-d]-tellurazole)); tellurazoline nuclei (for example, tellurazoline, 4-methyltellurazoline); 3,3-dialkylindolenine nuclei (for example, 3,3-dimethylindolenine, 3,3-diethylindolenine, 3,3-dimethyl-5-cyanoindolenine, 3,3-di-methyl-6 -nitroindolenine, 3,3-dimethyl-5-nitroindolenine, 3,3-dimethyl-5-methoxyindolenine, 3,3,5-trimethylindolenine, 3,3-dimethyl-5-chloroindolenine); imidazole nuclei (for example, imidazole nuclei (e.g., 1-alkylimidazole, 1-alkyl-4-phenylimidazole, 1-arylimidazole), benzimidazole nuclei (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6 -chloro-5-trifluoromethylbenzimidazole, 1-allyl-5,6 -dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5 -methoxybenzimidazole, 1-aryl-5-cyanobenzimidazole), naphthoimidazole nuclei (e.g., 1-alkylnaphtho[1,2-d]imidazole, 1-arylnaphtho[1,2-d]imidazole), in which the above-described alkyl moiety has preferably from 1 to 8 carbon atoms; examples of the alkyl moiety include an unsubstituted alkyl group such as methyl, ethyl, propyl, isopropyl and butyl and a hydroxyalkyl group such as 2-hydroxyethyl and 3-hydroxypropyl with methyl and ethyl being particularly preferred; and examples of the above-described aryl moiety include a phenyl group, a halogen-substituted phenyl group such as chlorophenyl, an alkyl-substituted phenyl group such as methylphenyl and an alkoxy-substituted phenyl group such as methoxyphenyl); pyridine nuclei (for example, 2-pyridine, 4-pyridine, 5-methyl-2-pyridine, 3-methyl-4-pyridine); quinoline nuclei (for example, quinoline nuclei (e.g., 2-quinoline, 3-methyl-2-qionoline, 5-methyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline, 5,6-dimethyl-4-quinoline), isoquinoline nuclei (e.g., 6-nitro-1-isoquinoline, 3,4-dihydro-1-isoquinoline, 6-nitro-3-isoquinoline)); imidazo-[4,5-b]quinoxaline nuclei (for example, 1,3-diethylimidazo[4,5-b] quinoxaline, 6-chloro-1,3-diallylimidazo-[4,5-b] quinoxaline); oxadiazole nuclei; thiadiazole nuclei; tetrazole nuclei; and pyrimidine nuclei.

The nuclei formed by $Z_{31}$ and $Z_{32}$ are preferably benzthiazole nuclei, benzoxazole nuclei, naphthoxazole nuclei and benzimidazole nuclei.

In formula (III), $R_{31}$ and $R_{32}$ have the same meaning as $R_{11}$ and $R_{12}$ in formula (I), and each is preferably a sulfoethyl group, a sulfopropyl group, a sulfobutyl group, a carboxymethyl group or a carboxyethyl group.

$R_{33}$ represents a hydrogen atom, a substituted or unsubstituted alkyl group (e.g., methyl, ethyl, propyl, butyl, hydroxyethyl, trifluoromethyl, 2-chloroethyl, chloromethyl, 2-methoxyethyl, benzyl) or a substituted or unsubstituted aryl group (e.g., phenyl, o-carboxyphenyl, p-tolyl, m-tolyl). Preferably, $R_{33}$ is a hydrogen atom, a methyl group or an ethyl group.

In formula (III), $X_{31}$ and p have the same meaning as $X_{11}$ and m in formula (I), respectively.

The compounds represented by formula (IV) will be illustrated in greater detail below.

In formula (IV), $Z_{41}$ has the same meaning as $Z_{31}$ and $Z_{32}$ in formula (III).

In formula (IV), $R_{41}$, $R_{42}$, $R_{43}$, $R_{44}$ and $R_{45}$ are the same or different and each represents a substituted amino group (e.g., diethylamino, hydroxyamino); an unsubstituted alkyl group having from 1 to 18 carbon atoms (e.g., methyl, ethyl, propyl, butyl, pentyl, octyl, decyl, dodecyl, octadecyl); a substituted alkyl group (for example, an alkyl group having from 1 to 18 carbon atoms in the alkyl moiety substituted by one or more of substituent groups such as a carboxyl group, a sulfo group, a cyano group, a halogen atom (e.g., fluorine, chlorine, bromine), a hydroxyl group, an alkoxycarbonyl group having from 2 to 8 carbon atoms (e.g., methoxycarbonyl, ethoxycarbonyl, benzyloxycarbonyl), an alkanesulfonylaminocarbonyl group having from 2 to 8 carbon atoms, an acylaminosulfonyl group having from 1 to 8 carbon atoms, an alkoxy group having from 1 to 8 carbon atoms (e.g., methoxy, ethoxy, benzyloxy, phenethyloxy), an alkylthio group having from 1 to 8 carbon atoms (e.g., methylthio, ethylthio, methylethylthioethyl), an aryloxy group having from 6 to 20 carbon atoms (e.g., phenoxy, p-tolyloxy, 1-naphthoxy, 2-naphthoxy), an acyloxy group having from 1 to 3 carbon atoms (e.g., acetyloxy, propionyloxy), an acyl group having from 1 to 8 carbon atoms (e.g., acetyl, propionyl, benzoyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl) and an aryl group having from 6 to 20 carbon atoms (e.g., phenyl, 4-chlorophenyl, 4-methylphenyl, α-naphthyl)); a hydrogen atom; a halogen atom (e.g., fluorine, chlorine, bromine, iodine); a hydroxyl group; a substituted or unsubstituted alkoxy group; (e.g., methoxy, ethoxy, propoxy, methylenedioxy); a substituted or unsubstituted aryl group ( e.g., phenyl, 4-chlorophenyl, 4-bromophenyl, 4-mehtylphenyl, pentafluorophenyl, 3-sulfophenyl); or a group capable of forming a five-membered or six-membered ring by condensed with adjoining substituent groups.

Among these, a diethylamino group, a hydroxyamino group, a methyl group, an ethyl group, a methoxy group, a chlorine atom, a bromine atom and a phenyl group are prefrerred. A diethylamino group, a methyl group, a methoxy group, a chlorine atom and a phenyl group are more preferred.

The compounds represented by formula (V) will be illustrated in greater detail below.

In formula (V), the alkyl group represented by $Z_{51}$, $Z_{52}$, $Z_{53}$, $R_{51}$, $R_{52}$, $R_{53}$, $R_{54}$ and $R_{55}$ may be substituted or unsubstituted, and examples thereof include a straight chain or cyclic alkyl group, an alkenyl group, an alkynyl group and an aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, phenethyl).

In formula (V), the aryl group represented by $Z_{51}$, $Z_{52}$, $Z_{53}$, $R_{51}$, $R_{52}$, $R_{53}$, $R_{54}$ and $R_{55}$ may be substituted or unsubstituted, and examples thereof include a monocyclic or condensed aryl group (e.g., phenyl, pentafluorophenyl, 4-chlorophenyl, 3-sulfophenyl, 1-naphthyl, 4-methylphenyl).

In formula (V), the heterocyclic group represented by $Z_{51}$, $Z_{52}$, $Z_{53}$, $R_{51}$, $R_{52}$, $R_{53}$, $R_{54}$ and $R_{55}$ may be substituted or unsubstituted, and examples thereof include a three-membered to ten-membered saturated or unsaturated heterocyclic group having at least one hetero-atom of nitrogen atom, oxygen atom and sulfur atom as the member of the ring (e.g., pyridyl, thienyl, furyl, thiazolyl, imidazolyl, benzimidazolyl). Examples of the cation represented by $R_{51}$, $R_{54}$ and $R_{55}$ includes alkali metal ions and ammonium ions. Examples of the halogen atom represented by $Z_{51}$, $Z_{52}$ and $Z_{53}$ include a fluorine atom, a chlorine atom,a bromine atom and an iodine atom.

In formula (V), $Z_{51}$, $Z_{52}$ and $Z_{53}$ are each preferably a straight chain or cyclic alkyl group or a monocyclic or condensed aryl group.

In formula (V), more preferred is a trialkylphosphine selenide, a triarylphosphine selenide, a trialkyl selenophosphate or a triaryl selenophosphate.

Specific examples of the compounds represented by formulas (I), (II), (III), (IV) and (V) are shown below, but are not limited to the following compounds.

Compounds represented by formula (I):

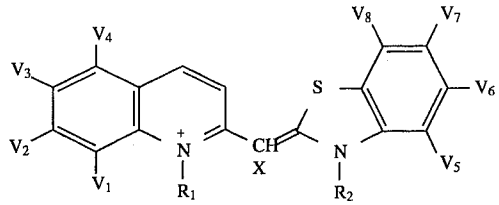

| No. | $V_1$ | $V_2$ | $V_3$ | $V_4$ | $V_5$ | $V_6$ | $V_7$ | $V_8$ | $R_1$ | $R_2$ | X |
|---|---|---|---|---|---|---|---|---|---|---|---|
| I-1 | H | H | H | H | H | H | H | H | $-C_2H_5$ | $-C_2H_5$ | $I^-$ |
| I-2 | H | H | H | H | H | Cl | H | H | $-C_2H_5$ | $-(CH_2)_4SO_3^-$ | — |
| I-3 | H | H | $-CH_3$ | H | H | Cl | H | H | $-(CH_2)_4SO_3^-$ | $-(CH_2)_4SO_3^-$ | $NH^+(C_2H_5)_3$ |
| I-4 | H | H | $-C_2H_5$ | H | H | 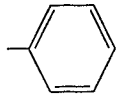 | H | H | $-CH_2COOH$ | $-(CH_2)_4SO_3^-$ | — |
| I-5 | H | H | 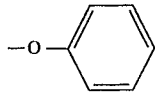 | H | H | Br | H | H | $-(CH_2)_3SO_3^-$ | $-CH_2CH_2CH(CH_3)SO_3^-$ | $K^+$ |
| I-6 | H | H | 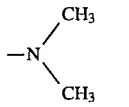 | H | H | Cl | $-CH_3$ | H | $-{}^nC_5H_{11}$ | $-(CH_2)_4SO_3^-$ | — |
| I-7 | H | H | Cl | H | $-OCH_3$ | H | H | H | $-(CH_2)_2SO_3^-$ | $-(CH_2)_2SO_3^-$ | $NH^+(C_2H_5)_3$ |
| I-8 | H | $-CH_3$ | $-CH_3$ | H | H | Cl | H | H | $-(CH_2)_4SO_3^-$ | $-(CH_2)_4SO_3^-$ | 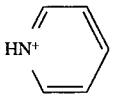 |
| I-9 | H | Cl | $-CH_3$ | H | H | H | H | $-OCH_3$ | $-(CH_2)_2SCH_3$ | $-(CH_2)_3SO_3^-$ | — |
| I-10 | H | $-CH_3$ | H | $CH_3$ | H | Cl | H | H | $-CH_2NHCOSO_2CH_3$ | $-(CH_2)_4SO_3^-$ | — |

-continued
| | | | | | | | | | | | |
|---|---|---|---|---|---|---|---|---|---|---|---|
| I-11 | $-CH_3$ | H | $-CH_3$ | H | H | $-SCH_3$ | $-SCH_3$ | H | $-(CH_2)_2O-C_6H_4$ | $-(CH_2)_2O-C_6H_4$ | $I^-$ |
| I-12 | H | H | $-SCH_3$ | H | H | $-OCH_3$ | $-OCH_3$ | H | $-(CH_2)_4SO_3^-$ | $-(CH_2)_4SO_3^-$ | $Li^+$ |
| I-13 | H | $-SCH_3$ | $-SCH_3$ | H | H | $-COCH_3$ | H | H | $-(CH_2)_2COOH$ | $-(CH_2)_4SO_3^-$ | — |
I-14
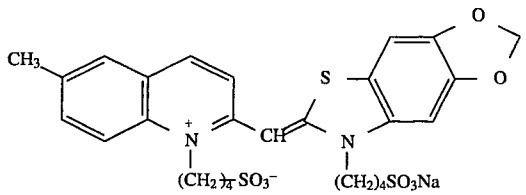
I-15
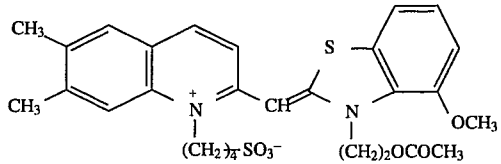
I-16
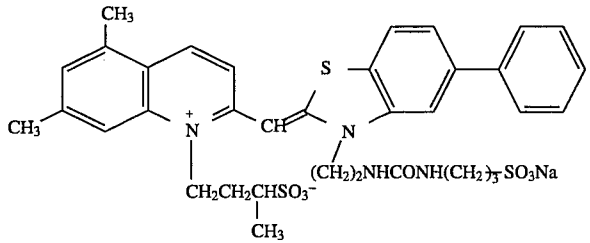

-continued
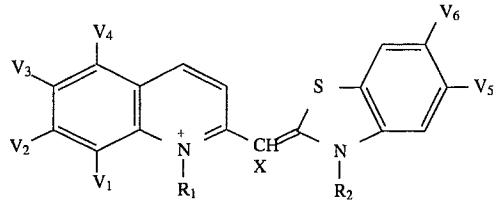
| No. | $V_1$ | $V_2$ | $V_3$ | $V_4$ | $V_5$ | $V_6$ | $R_1$ | $R_2$ | X |
|---|---|---|---|---|---|---|---|---|---|
| I-17 | H | H | H | H | H | H | $-C_2H_5$ | $-C_2H_5$ | $Br^-$ |
| I-18 | H | H | $-CH_3$ | H | Cl | H | $-(CH_2)_4SO_3^-$ | $-(CH_2)_4SO_3^-$ | $Na^+$ |
| I-19 | H | $-CH_3$ | $-CH_3$ | H | Cl | $-CH_3$ | $-CH_2CH_2CH(CH_3)SO_3^-$ | $-C_2H_5$ | — |
| I-20 | $-CH_3$ | H | $-CH_3$ | H | 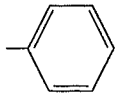 | H | $-(CH_2)_2CONHSO_2CH_3$ | $-(CH_2)_4SO_3^-$ | — |
| I-21 | H | $-CH_3$ | H | $-CH_3$ | Br | H | $-(CH_2)_2SO_3^-$ | $-(CH_2)_2SO_3^-$ | $HN^+(C_2H_5)_3$ |
| I-22 | H | H | $-C_2H_5$ | H | H | $-OCH_3$ | $-(CH_2)_2OH$ | $-(CH_2)_2OH$ | $Br^-$ |
| I-23 | H | H | Cl | H | H | $-CH_3$ | $-(CH_2)_3SO_3^-$ | $-(CH_2)_2COOH$ | — |

Compounds represented by formula (II):

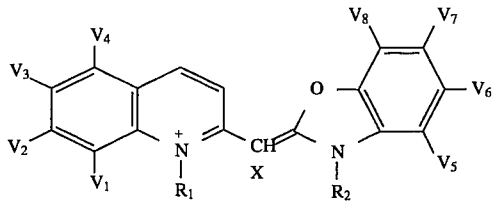

| No. | $V_1$ | $V_2$ | $V_3$ | $V_4$ | $V_5$ | $V_6$ | $V_7$ | $V_8$ | $R_1$ | $R_2$ | X |
|---|---|---|---|---|---|---|---|---|---|---|---|
| II-1 | H | H | H | H | H | Cl | H | H | $-C_2H_5$ | $-C_2H_5$ | $I^-$ |
| II-2 | H | H | H | H | H | Cl | H | H | $-(CH_2)_4SO_3^-$ | $-(CH_2)_4SO_3^-$ | $Na^+$ |
| II-3 | H | H | H | H | H | Cl | $CH_3$ | H | $-(CH_2)_3SO_3^-$ | $-(CH_2)_3SO_3^-$ | 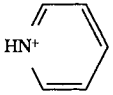 |
| II-4 | H | H | H | H | H | 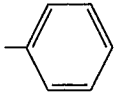 | H | H | $-(CH_2)_2SO_3^-$ | $-(CH_2)_2SO_3^-$ | $K^+$ |
| II-5 | H | H | $-CH_3$ | H | H | 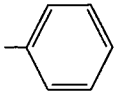 | H | H | $-C_2H_5$ | $-(CH_2)_4SO_3^-$ | — |
| II-6 | H | H | $-CH_3$ | H | H | Br | H | H | $-(CH_2)_3SO_3^-$ | $-(CH_2)_3SO_3^-$ | $Na^+$ |
| II-7 | H | H | $-C_2H_5$ | H | H | $^tAm$ | H | H | $-CH_2COOH$ | $-(CH_2)_4SO_3^-$ | — |
| II-8 | H | H | 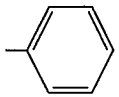 | H | Cl | H | H | H | $-C_3H_7$ | $-CH_2CH_2\overset{CH_3}{\overset{\vert}{C}}HSO_3^-$ | — |
| II-9 | H | H | 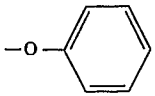 | H | H | H | Cl | H | $-CH_3$ | $-CH_3$ | 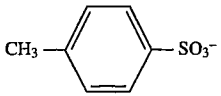 |
| II-10 | $-CH_3$ | H | H | H | H | H | H | Cl | $-C_2H_5$ | $-(CH_2)_4SO_3^-$ | — |

-continued

| | | | | | | | | | | | |
|---|---|---|---|---|---|---|---|---|---|---|---|
| II-11 | H | $-CH_3$ | H | H | H | 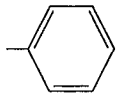 | $-CH_3$ | H | $\leftarrow CH_2)_4SO_3^-$ | $\leftarrow CH_2)_3SO_3^-$ | $^+NH(C_2H_5)_3$ |
| II-12 | H | H | H | $-CH_3$ | H | $-OCH_3$ | H | H | $\leftarrow CH_2)_2COOH$ | $\leftarrow CH_2)_3SO_3^-$ | — |
| II-13 | H | $-CH_3$ | H | $-CH_3$ | H | 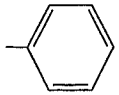 | H | H | $\leftarrow CH_2)_4SO_3^-$ | $\leftarrow CH_2)_4SO_3^-$ | $K^+$ |
| II-14 | H | H | Cl | H | H | Br | H | H | $\leftarrow CH_2)_4SO_3^-$ | $\leftarrow CH_2)_4SO_3^-$ | $H^+$ |
| II-15 | H | H | $-N(C_2H_5)_2$ | H | H | F | H | H | $-CH_3$ | $-CH_3$ | $I^-$ |
| II-16 | H | H | $-CH_3$ | H | H | 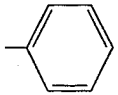 | H | H | $\leftarrow CH_2)_4SO_3^-$ | $\leftarrow CH_2)_4SO_3^-$ | $Na^+$ |

Note: $t^{Am}$ of No. II-7 means a tert-amyl group.

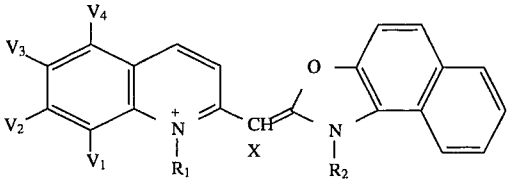

| No. | $V_1$ | $V_2$ | $V_3$ | $V_4$ | $R_1$ | $R_1$ | X |
|---|---|---|---|---|---|---|---|
| II-13 | H | H | H | H | $-C_2H_5$ | $-C_2H_5$ | $I^-$ |
| II-14 | H | H | H | H | $-C_2H_5$ | $\leftarrow CH_2)_3SO_3^-$ | — |
| II-15 | H | H | $-CH_3$ | H | $\leftarrow CH_2)_4SO_3^-$ | $\leftarrow CH_2)_3SO_3^-$ | $Na^+$ |
| II-16 | H | $-CH_3$ | $-CH_3$ | H | $\leftarrow CH_2)_4SO_3^-$ | $\leftarrow CH_2)_2OSO_3^-$ | $Na^+$ |
| II-17 | H | H | 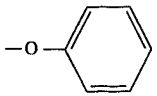 | H | $\leftarrow CH_2)_3SO_3^-$ | $-CH_3$ | — |

-continued

| | | | | | | | |
|---|---|---|---|---|---|---|---|
| II-18 | H | $-CH_3$ | H | $-CH_3$ | $-(CH_2)_2SO_3^-$ | $-(CH_2)_3SO_3^-$ | $HN^+(C_2H_5)_3$ |
| II-19 | H | $-C_2H_5$ | H | H | $-CH_3$ | $-CH_3$ | $I^-$ |
| II-20 | H | H | Cl | H | $-{}^iC_3H_7$ | $-C_2H_5$ | $Br^-$ |

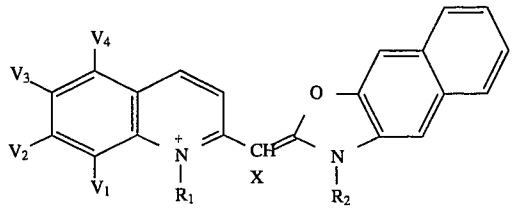

| No. | $V_1$ | $V_2$ | $V_3$ | $V_4$ | $R_1$ | $R_1$ | X |
|---|---|---|---|---|---|---|---|
| II-21 | H | H | H | H | $-CH_3$ | $-CH_3$ | $I^-$ |
| II-22 | H | H | $-CH_3$ | H | $-(CH_2)_4SO_3^-$ | $-(CH_2)_4SO_3^-$ | $Na^+$ |
| II-23 | H | $-CH_3$ | H | H | $-(CH_2)_2SO_3^-$ | $-(CH_2)_3SO_3^-$ | $HN^+(C_2H_5)_3$ |
| II-24 | H | $-CH_3$ | H | $-CH_3$ | $-(CH_2)_2COOH$ | $-(CH_2)_2OSO_3^-$ | — |
| II-25 | H | H | 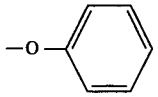 | H | $-(CH_2)_2OSO_3^-$ | $-(CH_2)_2SO_3^-$ | $Li^+$ |
| II-26 | H | H | Cl | H | $-C_2H_5$ | $-(CH_2)_4SO_3^-$ | — |

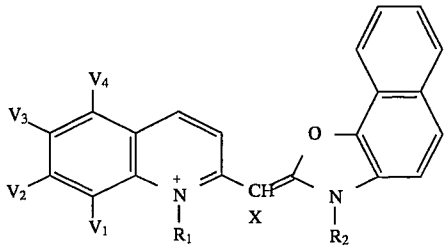

| No. | $V_1$ | $V_2$ | $V_3$ | $V_4$ | $R_1$ | $R_1$ | X |
|---|---|---|---|---|---|---|---|
| II-27 | H | H | H | H | $-(CH_2)_4SO_3^-$ | $-(CH_2)_4SO_3^-$ | $K^+$ |

-continued
| | | | | | | | |
|---|---|---|---|---|---|---|---|
| II-28 | H | H | $-CH_3$ | H | $-(CH_2)_4SO_3^-$ | $-(CH_2)_2SO_3^-$ | 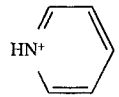 |
| II-29 | H | $-CH_3$ | H | H | $-CH_3$ | $-C_2H_5$ | $I^-$ |
| II-30 | H | $-CH_3$ | H | $-CH_3$ | $-{}^nC_5H_{11}$ | $-(CH_2)_3SO_3^-$ | — |
| II-31 | H | H | $-Cl$ | H | $-(CH_2)_4SO_3^-$ | $-(CH_2)_4SO_3^-$ | $Na^+$ |

Compounds represented by the formula (III):

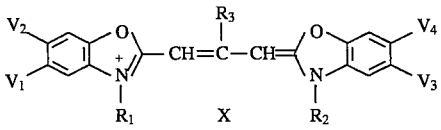

| No. | $V_1$ | $V_2$ | $V_3$ | $V_4$ | $R_1$ | $R_2$ | $R_3$ | X |
|---|---|---|---|---|---|---|---|---|
| III-1 | 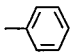 | H | 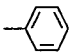 | H | $-(CH_2)_2SO_3^-$ | $-(CH_2)_2SO_3^-$ | $-C_2H_5$ | 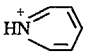 |
| III-2 | Cl | H | Cl | H | $-(CH_2)_3SO_3^-$ | $-(CH_2)_3SO_3^-$ | $-C_2H_5$ | $Na^+$ |
| III-3 | 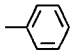 | H | Cl | H | $-(CH_2)_2SO_3^-$ | $-(CH_2)_4SO_3^-$ | $-C_2H_5$ | $Na^+$ |
| III-4 | 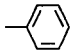 | H | $-CH_3$ | H | $-(CH_2)_2SO_3^-$ | $-(CH_2)_4SO_3^-$ | $-C_2H_5$ | $Na^+$ |
| III-5 | Cl | $-CH_3$ | Cl | $-CH_3$ | $-CH_2CH_2CH(CH_3)SO_3^-$ | $-CH_2CH_2CH(CH_3)SO_3^-$ | $-C_2H_5$ | $\overset{+}{N}H(C_2H_5)_3$ |
| III-6 | Cl | H | Cl | H | $-(CH_2)_2COO^-$ | $-(CH_2)_2COONa$ | $-{}^nC_3H_7$ | — |
| III-7 | 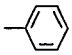 | H | Br | H | $-C_2H_5$ | $-(CH_2)_3SO_3^-$ | 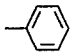 | — |
| III-8 | Br | H | Br | H | $-C_2H_5$ | $-C_2H_5$ | $-C_2H_5$ | $I^-$ |
| III-9 | 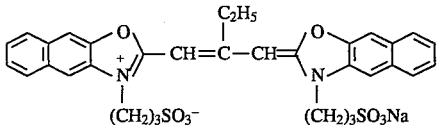 | | | | | | | |
| III-10 | 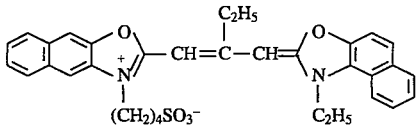 | | | | | | | |
| III-11 | 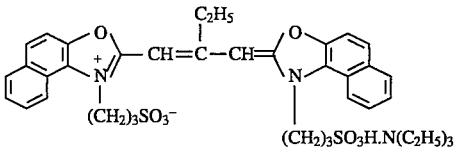 | | | | | | | |
| III-12 | 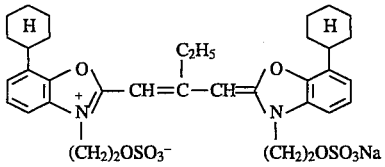 | | | | | | | |
| III-13 | 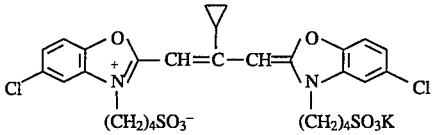 | | | | | | | |
| III-14 | 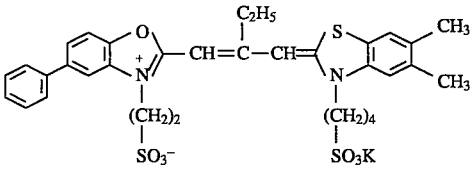 | | | | | | | |

-continued
| Compounds represented by the formula (III): | |
|---|---|
| III-15 | 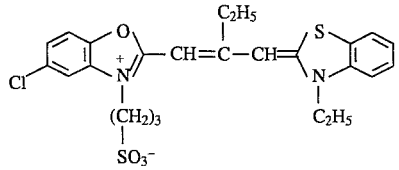 |
| III-16 | 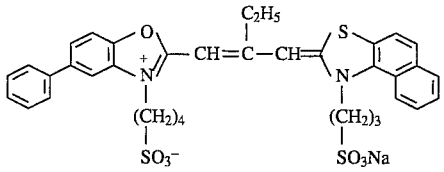 |
| III-17 | 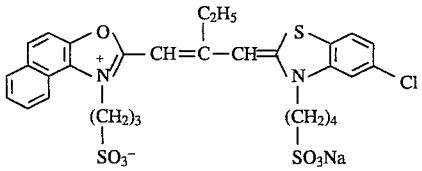 |
| III-18 | 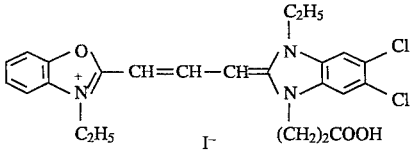 |
| III-19 | 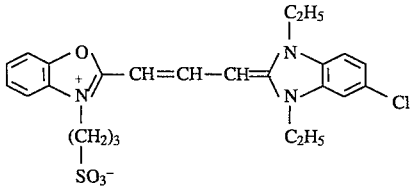 |
| III-20 | 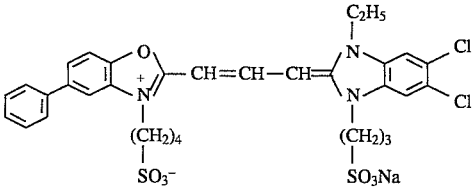 |
| III-21 | 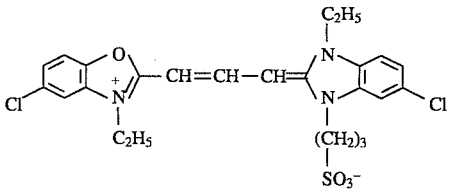 |
| III-22 | 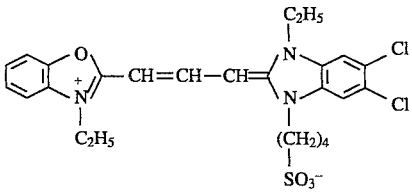 |

-continued
| Compounds represented by the formula (III): | |
|---|---|
| III-23 | 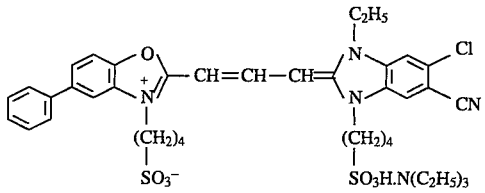 |
| III-24 | 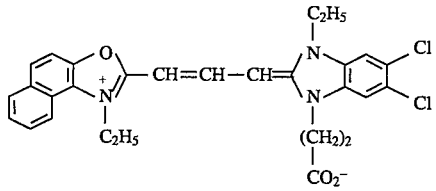 |
| III-25 | 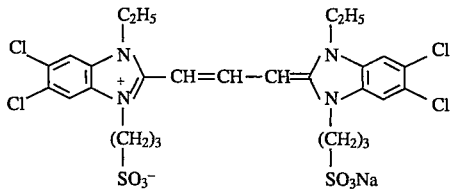 |
| III-26 | 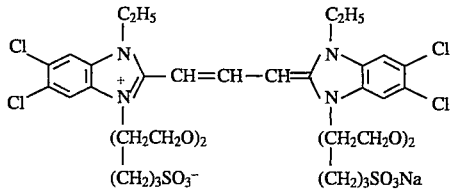 |
| III-27 | 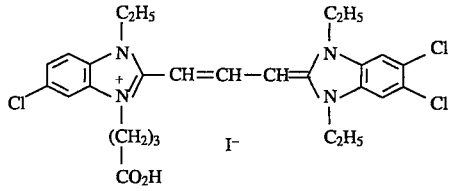 |
| III-28 | 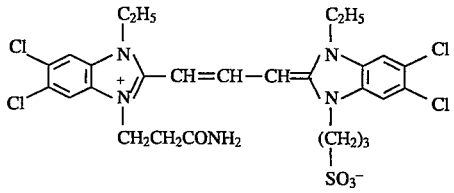 |
| III-29 | 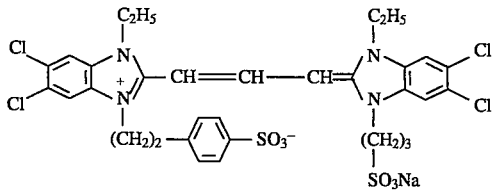 |
| III-30 | 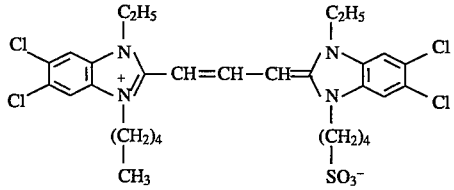 |

-continued

Compounds represented by the formula (III):

III-31

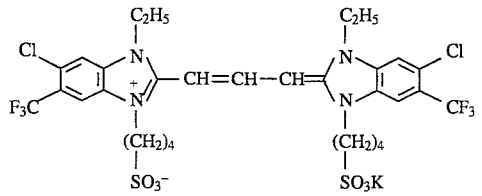

III-32

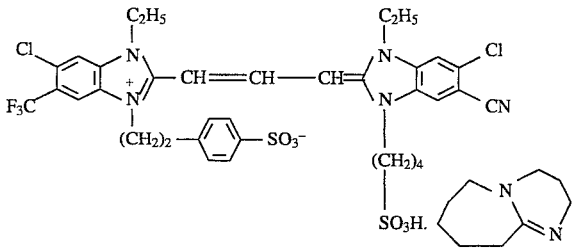

III-33

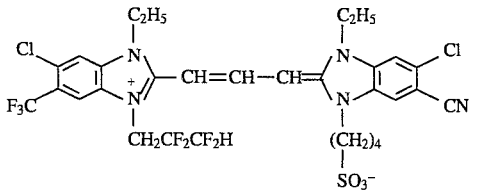

III-34

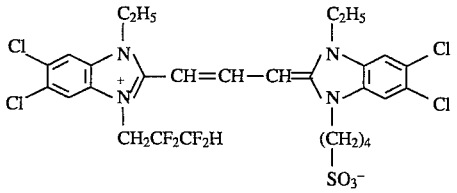

III-35

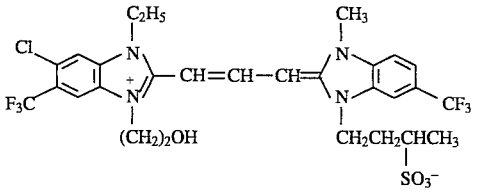

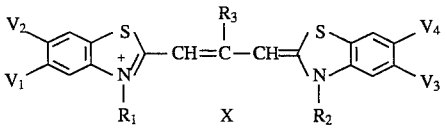

| No. | $V_1$ | $V_2$ | $V_3$ | $V_4$ | $R_1$ | $R_2$ | $R_3$ | X |
|---|---|---|---|---|---|---|---|---|
| III-36 | H | H | H | H | $-C_2H_5$ | $-C_2H_5$ | $-CH_3$ | $Br^-$ |
| III-37 | Cl | H | Cl | H | $+(CH_2)_2OH$ | $+(CH_2)_2OH$ | $-C_2H_5$ | $Br^-$ |
| III-38 | $-CH_3$ | H | $-CH_3$ | H | $+(CH_2)_2OH$ | $+(CH_2)_2OH$ | $-C_2H_5$ | $Br^-$ |
| III-39 | Cl | H | Cl | H | $-C_2H_5$ | $-C_2H_5$ | $-C_2H_5$ | $H_3C-C_6H_4-SO_3^-$ |
| III-40 | H | H | H | H | $-C_2H_5$ | $+(CH_2)_4SO_3^-$ | $-CH_3$ | — |
| III-41 | $-CH_3$ | H | $-CH_3$ | H | $+(CH_2)_3SO_3^-$ | $+(CH_2)_3SO_3H$ | $-C_2H_5$ | — |
| III-42 | Cl | $-CH_3$ | Cl | $-CH_3$ | $+(CH_2)_4SO_3^-$ | $+(CH_2)_4SO_3^-$ | $-C_2H_5$ | $Na^+$ |
| III-43 | $-OCH_3$ | H | $-C_6H_5$ | H | $-C_2H_5$ | $+(CH_2)_3SO_3^-$ | $-C_2H_5$ | — |

-continued
| Compounds represented by the formula (III): | | | | | | | | |
|---|---|---|---|---|---|---|---|---|
| III-44 | Cl | H | Cl | H | $-(CH_2)_3SO_3^-$ | $-(CH_2)_3SO_3^-$ | $-C_2H_5$ | $HN^+$ |
| III-45 | Cl | H | Cl | H | $-C_2H_5$ | $-(CH_2)_4SO_3^-$ | $-C_2H_5$ | — |
| III-46 | Cl | H | $-COOH$ | H | $-C_2H_5$ | $-(CH_2)_4SO_3^-$ | $-C_2H_5$ | — |
| III-47 | Cl | H | Cl | H | $-(CH_2)_4SO_3^-$ | $-CH_2CONHSO_2CH_3$ | $-C_2H_5$ | — |
| III-48 | $-C_6H_4-CH_3$ | H | $-C_6H_4-CH_3$ | H | $-(CH_2)_4SO_3^-$ | $-(CH_2)_4SO_3^-$ | $-C_2H_5$ | $\overset{+}{N}H(C_2H_5)_3$ |
III-49
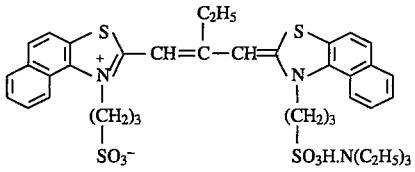
III-50
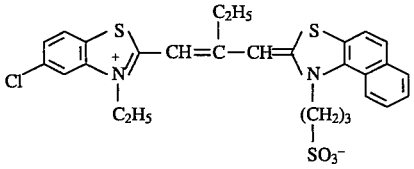
III-51
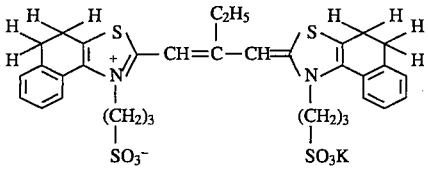
III-52
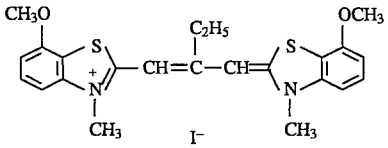
III-53
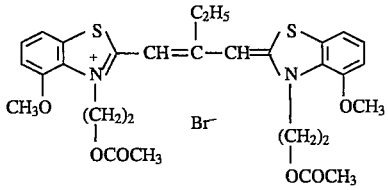
III-54
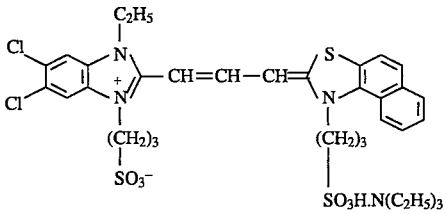
III-55
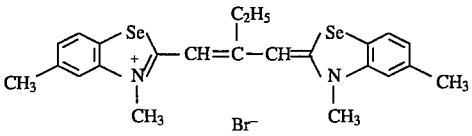

-continued

| Compounds represented by the formula (III): | |
|---|---|
| III-56 | 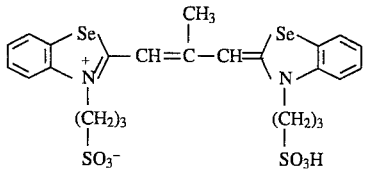 |
| III-57 | 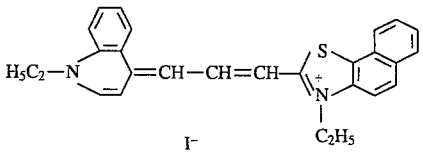 |

Compounds represented by formula (IV):

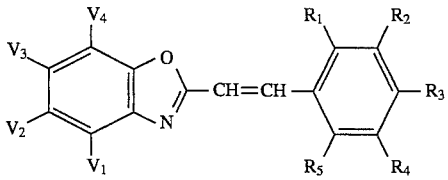

| No. | $V_1$ | $V_2$ | $V_3$ | $V_4$ | $R_1$ | $R_2$ | $R_3$ | $R_4$ | $R_5$ |
|---|---|---|---|---|---|---|---|---|---|
| IV-1 | H | H | H | H | H | H | $-N(CH_3)_2$ | H | H |
| IV-2 | H | Cl | H | H | H | H | $-N(C_2H_5)_2$ | H | H |
| IV-3 | H | 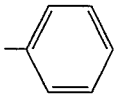 | H | H | H | H | Cl | H | H |
| IV-4 | H | Cl | $-CH_3$ | H | H | H | F | H | H |
| IV-5 | H | H | Cl | H | H | $-CH_3$ | H | $-CH_3$ | H |
| IV-6 | H | H | H | Cl | H | H | $-OCH_3$ | H | H |
| IV-7 | $-CH_3$ | H | H | H | $-OH$ | H | $-OH$ | H | H |
| IV-8 | H | $-COCH_3$ | H | H | H | H | 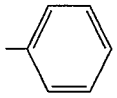 | H | H |
| IV-9 | H | $-OCH_3$ | H | H | $-CH_3$ | H | H | H | $-CH_3$ |
| IV-10 | H | $^tBu$ | H | H | H | H | Br | H | H |
| IV-11 | H | H | H | H | H | H | $-N(CH_3)_2$ | H | H |
| IV-12 | H | Cl | H | H | H | H | $-N(C_2H_5)_2$ | H | H |
| IV-13 | H | 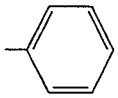 | H | H | $-CH_3$ | H | $-CH_3$ | H | H |
| IV-14 | H | Cl | $-CH_3$ | H | H | $-CH_3$ | H | $-CH_3$ | H |
| IV-15 | H | $-SCH_3$ | $-SCH_3$ | H | H | H | Cl | H | H |
| IV-16 | H | H | H | $-OCH_3$ | Cl | H | H | Cl | H |
| IV-17 | $-OCH_3$ | H | H | H | $-OCH_3$ | H | H | H | H |
| IV-18 | H | $-OCOCH_3$ | H | H | H | H | Br | H | H |
| IV-19 | H | $-OC_2H_5$ | H | H | H | H | 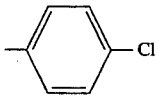 | H | H |
| IV-20 | H | $-CH_3$ | $-CH_3$ | H | H | H | 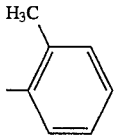 | H | H |

-continued
Compounds represented by formula (IV):
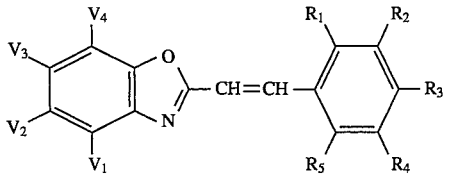
| No. | $V_1$ | $V_2$ | $V_3$ | $V_4$ | $R_1$ | $R_2$ | $R_3$ | $R_4$ | $R_5$ |
|---|---|---|---|---|---|---|---|---|---|
IV-21
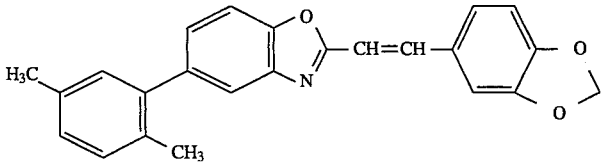
IV-22
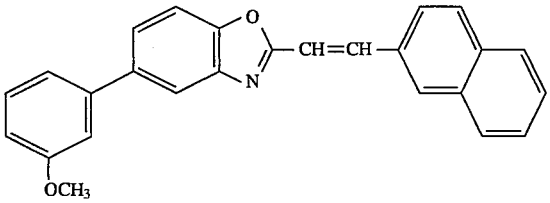
IV-23
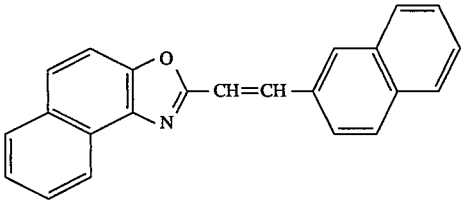
IV-24
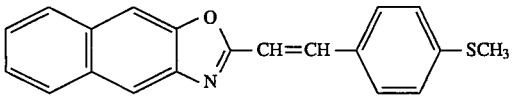
IV-25
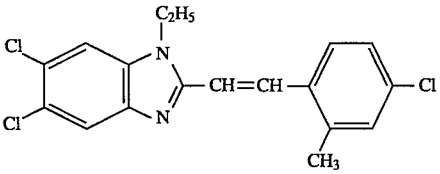
IV-26
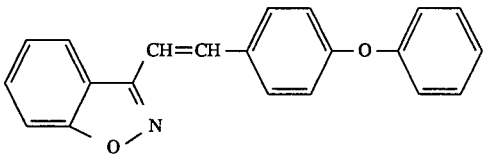
IV-27

-continued
Compounds represented by formula (IV):
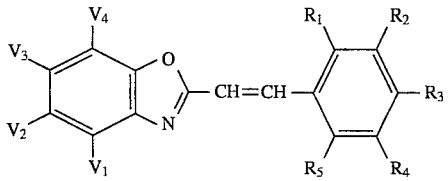
| No. | $V_1$ | $V_2$ | $V_3$ | $V_4$ | $R_1$ | $R_2$ | $R_3$ | $R_4$ | $R_5$ |
|---|---|---|---|---|---|---|---|---|---|
| 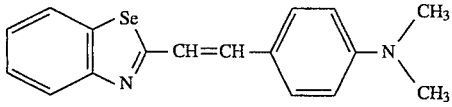 IV-28 | | | | | | | | | |
| 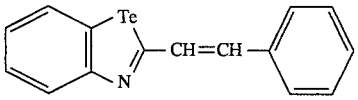 | | | | | | | | | |
Note:
$^t$Bu of No. IV-10 represents a tert-butyl group.
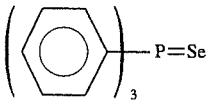 V-1
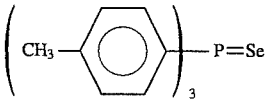 V-2
$(nC_4H_9)_3P{=}Se$ V-3
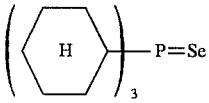 V-4
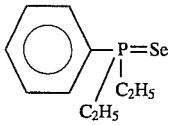 V-5
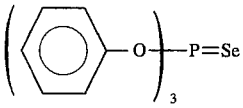 V-6
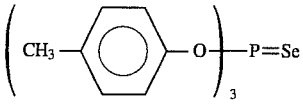 V-7
$(nC_4H_9O)_3P{=}Se$ V-8
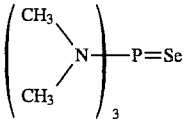 V-9
$(C_2H_5O)_3P{=}Se$ V-10
-continued
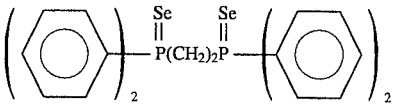 V-11
$(nC_8H_{17}O)_3P{=}Se$ V-12
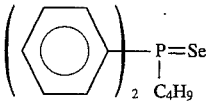 V-13
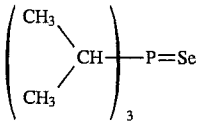 V-14
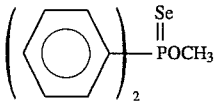 V-15
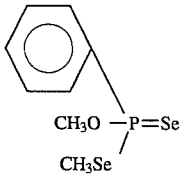 V-16
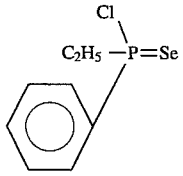 V-17
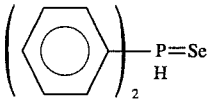 V-18

-continued

V-19

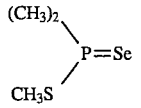

V-20

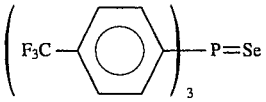

V-21

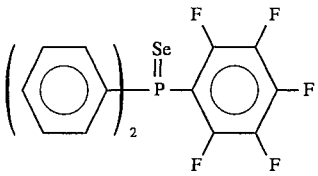

Selenium sensitization method is disclosed in U.S. Pat. Nos. 1,574,944, 1,602,592, 1,623,499, 3,297,446, 3,320,069, 3,408,196, 3,442,653, 3,420,670 and 3,591,685, French Patents 2,693,038 and 2,093,209, JP-B-52-34491, JP-B-52-34492, JP-B-53-295, JP-B-57-22090 and H. E. Spenser et al., *Journal of Photographic Science,* Vol. 31, pp. 158–169 (1983). Generally, selenium sensitization provides a large sensitization effect in comparison sensitization conventionally conducted in the art, but selenium sensitization is liable to cause fogging to occur and to cause low contrast.

The selenium sensitizing agents of general formula (V) are unstable selenium compounds which are reacted with silver nitrate in an aqueous solution to thereby form a silver selenide precipitate. Unstable selenium compounds are disclosed in U.S. Pat. Nos. 1,574,944, 1,602,592, 1,623,499 and 3,297,446. The amounts of the selenium sensitizing agents vary depending on the types of the selenium compounds to be used, silver halide grains and chemical ripening, but the selenium sensitizing agents are generally used in an amount of from $1\times10^{-8}$ to $1\times10^{-4}$ mol, preferably from $1\times10^{-7}$ to $1\times10^{-5}$ mol, per mol of silver halide. It is preferred that the selenium sensitizing agents are added after the formation of grains and further desalting.

The compounds represented by formulas (I), (II), (III) and (IV) according to the present invention can be synthesized by the methods described in F. M. Hammer, *Heterocyclic Compounds—Cyanine Dyes and Related Compounds* (John Wiley and Sons, New York, London 1964), D. M. Sturmer, *Heterocyclic Compounds—Special Topics in Heterocyclic Chemistry,* Chapter 18, Paragraph 14, pp. 482–515 (John Wiley and Sons, New York, London 1977), *Rodd's Chemistry of Carbon Compounds,* (2nd. Ed. Vol. IV, part B 1977) Chapter 15, pp. 369–422, ibid., (2nd Ed. Vol. IV, part B 1985) Chapter 15, pp. 267–296 (Elsevier Science Publishing Company Inc. New York).

Synthesis examples of Compound I-3 and Compound II-16 according to the present invention will be illustrated below.

Synthesis of Compound I-3

After 72.3 g (0.46 mol) of 2,6-dimethylquinoline and 188 g (1.4 mol) of butane sultone were heated at 145° C. with stirring for 4 hours, the mixture was allowed to cool to room temperature, and 500 ml of acetone was added thereto. While cooling, crystallization was conducted for 30 minutes. The resulting crystal was recovered by filtration, washed with acetone and dried to obtain 127.3 g (yield: 94%) of 4-[2,6-dimethyl-1-quinolinio]butane sulfonate.

Subsequently, 102.6 g (0.36 mol) of 4-[2,6-dimethyl-1-quinolinio]butane sulfonate and 166 g (0.35 mol) of 4-[5-chloro-2-(4-sulfobutylthio) benzthiazolio]butane sulfonate were suspended in 1,000 ml of ethanol, and 102 ml (0.73 mol) of triethylamine was added thereto. The mixture was heated under reflux for 30 minutes to thereby precipitate the crude crystal of Compound 1-3. The crude crystal was recovered by filtration was dissolved in 200 ml of methanol, and acetone was added thereto to precipitate a crystal. The resulting crystal was concentrated and recrystallized from methanol to obtain 124 g (yield: 51%) of Compound I-3 having an HPLC purity of 99.9%.

λmax (MeOH)=489.7 nm

Melting Point: 300° C. or higher.

The term "λmax (MeOH)" as used herein means an "absorption maximum in methanol".

Synthesis of Compound II-16

There were suspended 3.25 g (10 mmol) of 4-[6-methyl-2-methylthio-1-quinolinio]butane sulfonate and 3.45 g (10 mmol) of 4-[5-phenyl-2-methylbenzoxazolio]butane sulfonate in 200 ml of isopropanol, and 7 ml (50 mmol) of triethylamine was added thereto. The mixture was heated under reflux for 5 hours. Subsequently, 100 ml of isopropanol was distilled off, and the reaction mixture (solution) was cooled with an ice bath to precipitate the crude crystal of triethylamine salt of Compound II-16. The crude crystal was recovered by filtration and dissolved in 100 ml of methanol. Subsequently, 1.2 g of sodium acetate was added thereto, and the resulting solution was heated under reflux for 10 minutes to thereby convert the triethylamine salt into sodium salt. The methanol solution was cooled to precipitate a crystal. The crystal was recovered by filtration and washed with methanol to obtain Compound II-16 having an HPLC purity of 99.9%.

Yield: 1.4 g (19%)

λmax =457.8 nm (MeOH)

Melting Point: 300° C. or higher.

The spectral sensitizing dyes can be contained in silver halide emulsions by directly dispersing them in the emulsions or by dissolving them in a solvent such as water, methanol, ethanol, propanol, methyl cellosolve or 2,2,3,3-tetrafluoropropanol alone or a mixture thereof and adding the resulting solution to the emulsions. An aqueous solution may be prepared by using a base and added to the emulsions as described in JP-B-44-23389, JP-B-44-27555 and JP-B-57-22089. An aqueous solution or a colloidal dispersion may be prepared by using a surfactant and added to the emulsions as described in U.S. Pat. Nos. 3,822,135 and 4,006,025. The spectral sensitizing dyes may be dissolved in a substantially water-immiscible solvent such as phenoxy ethanol, and the resulting solution may be dispersed in water or hydrophilic colloid and added to the emulsions. Further, the dyes may be directly dispersed in hydrophilic colloid and the resulting dispersion may be added to the emulsions as described in JP-A-53-102733 and JP-A-58-105141.

Furthermore, there may be used a method wherein water-insoluble dyes are dispersed in a water-soluble solvent without dissolving them, and the resulting dispersion is added to the emulsions as described in JP-B-46-24185; and a method wherein water-insoluble dyes are mechanically crushed and dispersed in a water-soluble solvent, and the resulting dispersion is added to the emulsions as described in JP-B-61-45217. The dyes may be added to the emulsions at any stage of emulsion preparation conventionally carried out. Namely, the dyes may be added before or during the formation of silver halide grains; immediately after the formation of the grains, but before rinsing stage; before or during chemical sensitization; immediately after chemical sensitization, but before the solidification of the emulsions by cooling; or during the preparation of the coating solutions. Usually, the dyes may be added between after completion of chemical sensitization and before coating. However, the spectral sensitizing dyes and chemical sensitizing agents may be simultaneously added to carry out simultaneously spectral sensitization and chemical sensitization as described in U.S. Pat. Nos. 4,225,666. 3,628,969 and Spectral sensitization may be carried out before chemical sensitization, or the dyes may be added before completion of the formation of silver halide grain precipitates to initiate spectral sensitization as described in JP-A-58-113928. Further, the spectral sensitizing dyes may be added portionwise as described in U.S. Pat. No. 4,225,666. Namely, a part of the dye may be added before chemical sensitization, and the remainder may be added after chemical sensitization. The spectral sensitizing dyes may be added at any stage during the formation of silver halide grains as described in U.S. Pat. No. 4,183,756, etc. Of these methods, it is particularly preferred that the sensitizing dyes are added before the rinsing stage of the emulsions or before chemical sensitization.

The total amounts of these spectral sensitizing dyes (particularly the compounds represented by formulas (I), (II) and (IV)) used can be widely vary, but are preferably from $0.5\times10^{-6}$ to $1.0\times10^{-2}$ mol, more preferably from $1.0\times10^{-6}$ to $5.0\times10^{-3}$ mol, per mol of silver halide.

The compounds represented by formula (II) are used in an amount of from 10 to 90 mol %, preferably from 30 to 70 mol %, and more preferably from 40 to 50 mol %, based on the amount of the compounds represented by formula (I).

The compounds represented by formula (III) or formula (IV) are used in an amount of from 0.1 to 50 mol %, preferably from 0.1 to 10 mol %, and more preferably from 0.5 to 5.0 mol %, based on the total amounts of the compounds represeted formulas (I) and (II).

The compounds represented by formula (III) are used in an amount of preferably from 0.5 to 5.0 mol %, more preferably from 0.5 to 3.0 mol %, and most preferably from 0.5 to 1.0 mol %, based on the amount of the compounds represented by formula (I).

Preferred silver halides contained in the silver halide emulsions used in the present invention are silver bromide, silver iodobromide, silver iodochlorobromide, silver chlorobromide and silver chloride.

Silver halide grains used in the present invention may have a regular crystal form such as a cubic or octahedral form, an irregular crystal form such as a spherical or platy form or a composite form of these crystal forms. Further, a mixture of grains having various crystal forms may be used. However, grains having a regular crystal form are preferred.

The silver halide grains used in the present invention may be different in phase between the interior of the grain and the surface layer thereof or may be composed of a uniform phase. Further, the grains may be grains wherein a latent image is predominantly formed on the surface of the grain (e.g., negative type emulsions) or grains wherein a latent image is predominantly formed in the interior of the grain (e.g., internal latent image type emulsions, previously fogged direct reversal type emulsions). However, the grains wherein a latent image is predominantly formed on the surface of the grains are preferred.

The silver halide emulsions used in the present invention are preferably tabular grain emulsions composed of grains having such a grain size distribution that grains having a thickness of 0.5 microns or less, preferably 0.3 microns or less, a diameter of at least 0.6 microns or more and an average aspect ratio of 3 or more account for at least 50% of the entire projected areas of the entire grains; and monodisperse emulsions having a coefficient of variation (statisically) (a value S/d obtained by dividing the standard deviation S by the mean grain size d in a grain size distribution when the diameter of the grain is defined as the diameter of a circle having an area equal to the projected area of the grain) of 20% or less. A mixture of two or more of tabular grain emulsions or monodisperse emulsions may be used.

Photographic emulsions used in the present invention can be prepared by using the methods described in P. Glafkides, *Chemie et Physique Photographique* (Paul Montel 1967), G. F. Duffin, *Photographic Emulsion Chemistry* (Focal Press 1966) and V. L. Zelikman et al., *Making and Coating Photographic Emulsion* (Focal Press 1964).

Solvents for silver halide, such as ammonia, potassium thiocyanate, ammonium thiocyanate, thioether compounds (e.g., those described in U.S. Pat. Nos. 3,271,157, 3,574,628, 3,704,130, 4,297,439 and 4,276,374), thione compounds (e.g., those described in JP-A-53-144319, JP-A-53-82408 and JP-A-55-77737) and amine compounds (e.g., those described in JP-A-54-100717) can be used during the formation of the silver halide grains to control the growth of the grains.

A cadmium salt, a zinc salt, a thallium salt, an iridium salt or a complex salt thereof, a rhodium salt or a complex salt thereof, or an iron salt or a complex salt thereof may be allowed to coexist during the formation or physical ripening of the silver halide grains.

It is preferred that when silver iodobromide and silver iodochlorobromide are used in the emulsions of the photographic materials of the present invention, the relative standard deviation of the silver iodide content of individual silver halide grain in the emulsion is 20% or less in each emulsion. When the relative standard deviation exceeds 20%, fog is apt to be increased and gradation is liable to be deteriorated.

Specific methods for measuring the silver iodide content of individual grain include those described in JP-A-2-256043.

Silver halide emulsions used in the photographic materials of the present invention can be prepared by using the methods described in *Research Disclosure* (RD) No. 17643 (December 1978), pp. 22–23 "I. Emulsion Preparation and Types"; *Research Disclosure* No. 18716 (November 1979), page 648; P. Glafkides, *Chimie et Physique Photographique* (Paul Montel 1967); G. F. Duffin, *Photographic Emulsion Chemistry* (Focal Press 1966); and V. L. Zelikman et al., *Making and Coating Photographic Emulsion* (Focal Press 1964).

Monodisperse emulsions described in U.S. Pat. Nos. 3,754,628 and 3,655,394 and U.K. Patent 1,413,748 can be preferably used.

The crystal structure of the grain may be uniform or different in halogen composition between the interior of the grain and the surface layer thereof. The crystal structure may be a laminar structure. The grain may be joined to silver halide having a different composition by epitaxial growth or may be joined to other compound than silver halide, such as silver rhodanide or zinc oxide.

A mixture of grains having various crystal forms may be used.

The silver halide emulsions are usually subjected to physical ripening, chemical ripening and spectral sensitization and then used. Additives used in these stages are described in *Research Disclosure* (RD) No. 17643 and ibid. No. 18716, and places where the additives are described are listed below.

Further, conventional photographic additives which can be used in the present invention are also described in the above-described two *Research Disclosures* and are listed below.

| | Additive | RD 17643 | RD 18716 |
|---|---|---|---|
| 1. | Chemical Sensitizing Agent | page 23 | right column of page 648 |
| 2. | Sensitivity Increaser | — | right column of page 648 |
| 3. | Spectral Sensitizing Agent, Supersensitizing Agent | pages 23 to 24 | right column of page 648 to right column of page 649 |
| 4. | Brightener | page 24 | — |
| 5. | Anti-foggants Agent, Stabilizer | pages 24 to 25 | right column of page 649 |
| 6. | Light Absorber, Filter Dye, UV Absorber | pages 25 to 26 | right column of page 649 to left column of page 650 |
| 7. | Anti-staining Agent | right column of page 25 | left column to right column of page 650 |
| 8. | Dye Image Stabilizer | page 25 | — |
| 9. | Hardening Agent | page 26 | left column of page 651 |
| 10. | Binder | page 26 | left column of page 651 |
| 11. | Plasticizer, Lubricant | page 27 | right column of page 650 |
| 12. | Coating Aid, Surfactant | pages 26 to 27 | right column of page 650 |
| 13. | Antistatic Agent | page 27 | right column of page 650 |

Various color couplers can be used in the present invention. Specific examples thereof are described in patent specifications cited in the aforesaid *Research Disclosure* (RD) No. 17643, VII-C~G. Couplers which allow color development of the three primary colors (namely, yellow, magenta and cyan) by subtractive color photography to be conducted are important as color forming couplers. Specific examples of nondiffusing four equivalent type and two equivalent type couplers which can be preferably used in the present invention include the following couplers in addition to couplers described in the patent specifications cited in the aforesaid RD No. 17643, Item VII-C and D.

Typical examples of yellow couplers which can be used in the present invention include hydrophobic acylacetamide type couplers having a ballast group. Specific examples thereof are described in U.S. Pat. Nos. 2,407,210, 2,875,057 and 3,265,506. Two equivalent type yellow couplers can be preferably used in the present invention. Typical examples thereof include yellow couplers which are eliminated through oxygen atom described in U.S. Pat. Nos. 3,408,194, 3,447,928, 3,933,501 and 4,022,620; and yellow couplers which are eliminated through nitrogen atom described in JP-B-58-10739, U.S. Pat. Nos. 4,401,752 and 4,326,024, RD No. 18053 (April 1979), U.K. Patent 1,425,020 and West German Patent Laid Open Nos. 2,219,917, 2,261,361, 2,329,587 and 2,433,812. α-Pivaloylacetanilide type couplers are excellent in fastness of developed dyes, particularly fastness to light, and α-benzoylacetanilide type couplers provide high color density.

Magenta couplers which can be used in the present invention include hydrophobic indazolone and cyanacetyl couplers having a ballast group, preferably 5-pyrazolone and pyrazoloazole couplers. 5-Pyrazolone couplers where the 3-position thereof is substituted by an arylamino group or an acylamino group are preferred from the standpoint of the hue of developed dyes and color density. Typical examples thereof are described in U.S. Pat. Nos. 2,311,082, 2,343,703, 2,600,788, 2,908,573, 3,062,653, 3,152,896 and 3,936,015. As the eliminable groups of two equivalent type 5-pyrazolone couplers, nitrogen atom elimination group described in U.S. Pat. No. 4,310,619 and arylthio group described in U.S. Pat. No. 4,351,897 are particularly preferred. 5-Pyrazolone couplers having a ballast group described in European Patent 73,636 provide high color density. Examples of the pyrazoloazole couplers include pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure* No. 24220 (June 1984 ) and JP-A-60-33552 and pyrazolopyrazoles described in *Research Disclosure* No. 24230 (June 1984) and JP-A-60-43659. Imidazo[1,2-b]pyrazoles described in U.S. Pat. No. 4,500,630 are preferred from the viewpoint of fastness to light and less yellow secondary absorption, and pyrazolo[1,5-b][1,2,4]triazoles described in European Patent 119,860A are particularly preferred.

Cyan couplers which can be used in the present invention include hydrophobic nondiffusing naphthol and phenol couplers. Typical examples of the naphthol couplers include naphthol couplers described in U.S. Pat. No. 2,474,293 and preferably two equivalent type naphthol couplers which are eliminated through oxygen atom described in U.S. Pat. Nos. 4,052,212, 4,146,396, 4,228,233 and 4,296,200. Specific examples of the phenol couplers are described in U.S. Pat. Nos. 2,369,929, 2,801,171, 2,772,162 and 2,895,826. Cyan couplers having fastness to humidity and temperature can be preferably used in the present invention. Typical examples thereof include phenol cyan couplers having ethyl group or a higher alkyl group at the meta-position of the phenol nucleus described in U.S. Pat. No. 3,772,002; 2,5-diacylamino group-substituted phenol couplers described in U.S. Pat. Nos. 2,772,162, 3,758,308, 4,126,396, 4,334,011 and 4,327,173, West German Patent Laid Open No. 3,326,729 and European Patent 121,365; and phenol couplers having a phenylureido group at the 2-position and an acylamino group at the 5-position described in U.S. Pat. Nos. 3,446,622, 4,333,999, 4,451,559 and 4,427,767.

It is preferred that masking is made by containing colored couplers in color photographic materials for photographing in addition to the above couplers to thereby correct undesirable absorption of developed dyes. Typical examples of the colored couplers include yellow colored magenta couplers described in U.S. Pat. No. 4,163,670 and JP-B-57-39413 and magenta colored cyan couplers described in U.S. Pat. Nos. 4,004,929 and 4,138,253 and U.K. Patent 1,146,368. Examples of other colored couplers are described in aforesaid RD No. 17643, Item VII-G.

Graininess can be improved by using couplers whose developed dye has appropriate diffusibility. Specific examples of such couplers include magenta couplers described in U.S. Pat. No. 4,366,237 and U.K. Patent 2,125,570 and yellow, magenta and cyan couplers described in European Patent 96,570 and West German Laid Open No. 3,234,533.

The dye forming couplers and the above specific couplers may be in the form of a dimer or a higher polymer. Typical examples of dye forming polymer couplers are described in U.S. Pat. Nos. 3,451,820 and 4,080,211. Specific examples of magenta polymer couplers are described in U.K. Patent 2,102,173 and U.S. Pat. No. 4,367,282.

Couplers which release a photographically useful residue by coupling can be preferably used in the present invention. Useful DIR couplers which release a restrainer are described in the patent specifications cited in the aforesaid RD No. 17643, item VII-F.

Couplers which can be preferably used in combination with the present invention include developer-deactivated type couplers such as typically those described in JP-A-57-151944; timing type couplers such as typically those described in U.S. Pat. No. 4,248,962 and JP-A-57-154234; and reaction type couplers such as typically those described in JP-A-60-184248. Particularly preferred are developer-deactivated type DIR couplers described in JP-A-57-151944, JP-A-58-217932, JP-A-60-218644, JP-A-60-225156 and JP-A-60-233650 and reaction type DIR couplers described in JP-A-60-184248.

Suitable supports which can be used for the photographic materials containing the photographic emulsions of the present invention include those described in the aforesaid RD No. 17643 (page 28) and RD No. 18716 ( right column of page 647 to left column of page 648 ).

Examples of photographic materials to which the photographic emulsions of the present invention can be applied include various color photographic materials and black-and-white photographic materials such as color negative films for photographing (for general purpose, movie, etc.), reversal color films (for slide, movie, etc. with or without couplers), color photographic paper, color positive films (for movie, etc.), reversal color photographic paper, color light-sensitive materials for heat development, color photographic materials using silver dye bleaching process, photographic materials for plate making (for lith films, scanner films, etc.), X-ray photographic materials (for direct and indirect for medical use, industrial use, etc.), black-and-white negative films for photographing, black-and-white photographic paper, micro photographic materials (for COM, microfilms, etc.), diffusion transfer color photographic materials (for DTR, etc.), silver salt diffusion transfer photographic materials and print out photographic materials.

Exposure of photographic materials containing the photographic emulsions of the present invention to light may be conducted in conventional manner. Any of conventional light sources such as natural light (sunlight), tungsten lamp, fluorescent lamp, mercury vapor lamp, xenon arc lamp, carbon arc lamp, xenon flash lamp, cathode ray tube flying spot, light emitting diode, laser beam (e.g., gas laser, YAG laser, dye laser, semiconductor laser and secondary high frequency of these laser beams) and infrared light can be used. Further, exposure to light may be conducted by light emitted from phosphors excited by electron beam, X-rays, gamma rays or alpha rays. Exposure time may be $1/1000$ to 1 sec for cameras or may be shorter than $1/1000$ sec. For example, exposure time may be $1/10^4$ to $1/10^6$ sec by using xenon flash lamp or cathode ray tube. Exposure time may be longer than 1 sec. If desired, the spectral composition of light for exposure can be controlled by a color filter.

The photographic materials to which the photographic emulsions of the present invention can be applied can be developed by conventional methods described in the aforesaid RD No. 17643 (pages 28 to 29) and No. 18716 (left column to right column of page 651).

Color developing solutions used in the present invention contain conventional aromatic primary color developing agents. Preferred developing agents are p-phenylenediamine derivatives. Typical examples of the p-phenylenediamine derivatives include, but are not limited to, the following compounds.

| | |
|---|---|
| D-1 | N,N-Diethyl-p-phenylenediamine |
| D-2 | 2-Amino-5-diethylaminetoluene |
| D-3 | 2-Amino-5-(N-ethyl-N-laurylamino)toluene |
| D-4 | 4-[N-Ethyl-N-(β-hydroxyethyl)amino]aniline |
| D-5 | 2-Methyl-4-[N-ethyl-N-(β-hydroxyethyl)amino]-aniline |
| D-6 | 4-Amino-3-methyl-N-ethyl-N-[β-(methanesulfoneamido)ethyl]aniline |
| D-7 | N-(2-Amino-5-diethylaminophenylethyl)methanesulfoneamide. |
| D-8 | N,N-Dimethyl-p-phenylenediamine |
| D-9 | 4-Amino-3-methyl-N-ethyl-N-methoxyethylaniline |
| D-10 | 4-Amino-3-methyl-N-ethyl-N-β-ethoxyethylaniline |
| D-11 | 4-Amino-3-methyl-N-ethyl-N-β-butoxyethylaniline |

Of these p-phenylenediamine derivatives, compound D-5 is more preferred.

These p-phenylenediamine derivatives may be in the form of a salt such as sulfate, hydrochloride, sulfite or p-toluenesulfonate.

The color developing agents are used in an amount of from 0.013 to 0.065 mol per liter of the color developing solution, but it is preferred from the standpoint of rapid processing that the color developing agents are used in an amount of from 0.016 to 0.048 mol, preferably from 0.019 to 0.032 mol, per liter of the color developing solution.

The color developing solutions may optionally contain sulfites such as sodium sulfite, potassium sulfite, sodium bisulfite, potassium bisulfite, sodium metabisulfite and potassium metabisulfite and carbonyl sulfite adducts as preservatives.

The preservatives are used in an amount of preferably 0.5 to 10 g, more preferably 1 to 5 g, per liter of the color developing solution.

It is preferred that the color developing solutions contain hydroxylamines (e.g., compounds described in JP-A-63-5341 and JP-A-63-106655, and compounds having a sulfo group or a carboxyl group therein are preferred), hydroximic acids described in JP-A-63-43138, hydrazines and hydrazides described in JP-A-63-146041, phenols described in JP-A-63-44657 and JP-A-63-58443, α-hydroxyketones and α-aminoketones described in JP-A-63-44656 and/or saccharides described in JP-A-63-36244 as compounds which directly preserve the aromatic primary amine color developing agents. Further, it is preferred that monoamines described in JP-A-63-4235, JP-A-63-24254, JP-A-63-21647, JP-A-63-146040, JP-A-63-27841 and JP-A-63-25654; diamines described in JP-A-63-30845, JP-A-63-14640 and JP-A-63-43139; polyamines described in JP-A-63-21647, JP-A-63-26655 and JP-A-63-44655; nitroxy radicals described in JP-A-63-53551; alcohols described in JP-A-63-43140 and JP-A-63-53549; oximes described in JP-A-63-56654; and tert-amines described in JP-A-63-239447 are used together with the above-described compounds.

Examples of other preservatives which may be optionally contained include metals described in JP-A-57-44148 and JP-A-57-53749; salicylic acids described in JP-A-59-180588; alkanolamines described in JP-A-54-3582; polyethyleneimines described in JP-A-56-94349; and aromatic polyhydroxy compounds described in U.S. Pat. No. 3,746,544. The addition of the aromatic polyhydroxy compounds is particularly preferred.

The pH of the color developing solutions is generally from 9 to 12. From the standpoint of rapid processing, the pH is preferably 10.2 to 12, more preferably from 10.5 to 11.5.

When the pH is increased, both silver development and color reaction can be accelerated, and it is particularly effective in accelerating the color formation of the cyan dyes.

It is preferred that the amount of alkali metal hydroxides such as potassium hydroxide and sodium hydroxide as well as alkali buffering agents such as potassium carbonate and sodium tertiary phosphate are increased to raise the pH. The buffering agents are used in an amount of from 0.2 to 1.0 mol, preferably from 0.3 to 0.8 mol, and more preferably from 0.35 to 0.5 mol, per liter of the developing solution.

The development stage may be conducted by using two or more baths having different pH values. For example, the first bath contains a developing solution having a pH of 9 or lower and processing is carried out in a very short time. Subsequently, processing is carried out with a developing solution having a high pH of 10.5 or higher, whereby the balance of development progress in the upper and lower layers can be controlled.

It is preferred that buffering agents are used to keep the pH in the range described above.

Specific examples of the buffering agents include, but are not limited to, sodium carbonate, potassium carbonate, sodium bicarbonate, potassium bicarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate ) and potassium 5-sulfo-2-hydroxybenzoate (potassium 5-sulfosalicylate).

The buffering agents are used in an amount of preferably 0.1 mol or more, more preferably from 0.1 to 0.4 mol, per liter of the color developing solution.

Further, the color developing solutions may contain chelating agents as a suspending agent for calcium and magnesium or to improve the stability of the color developing solution.

Preferred chelating agents are organic acid compounds such as aminopolycarboxylic acids, organic phosphonic acids and phosphonocarboxylic acids. Examples thereof include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraaceitc acid, hydroxyethyliminodiacetic acid, glycol ether diaminetetraacetic acid, ethylenediamine-hydroxyphenylacetic acid, 2-phosphonobutane-1,2,4-tricarboxylic acid, 1-hydroxyethylidene-1,1-diphosphonic acid and N,N'-bis(2-hydroxybenzyl)ethylenediamine-N,N'-diacetic acid. These chelating agents may be used in combination of two or more of them. These chelating agents may be used in an amount sufficient to sequester metal ions present in the color developing solutions. For example, the chelating agents are used in an amount of from 0.1 to 10 g per liter of the color developing solution.

The color developing solutions contain a bromide in an amount of 0.02 mol/liter or less to inhibit fogging and to control gradation. It is preferred from the standpoint from rapid processing that the bromide is used in an amount of 0.015 mol/liter or less. Examples of the bromide which can be preferably used include alkali metal bromides such as potassium bromide, sodium bromide and lithium bromide.

Anti-fogging agents can be used to inhibit fogging and to improve discrimination. Preferred examples of the anti-fogging agents include organic anti-fogging agents described in L. F. A. Mayson, *Photographic Processing Chemistry,* the second edition (1975 ) pp. 39–42, such as benztriazole, 5-methylbenztriazole, 6-nitrobenzimidazole, 5-phenyltetrazole and 1-phenyl-5-mercaptotetrazole. The preferred amount thereof is also described in the above literature.

4-Hydroxy-6-methyl-1,3,3a,7-tetrazaindene, etc. described in T. H. James, *The Theory of Photographic Processing,* the 4th edition, pp. 398–399 can be preferably used, and the amount compound to be used is substantially the same as that of the above organic anti-fogging agent.

It is preferred from the standpoint of rapid processing that the color developing solutions contain development accelerators. Examples of the development accelerators include compounds described in the aforesaid literature, pp. 41–44, written by L. F. A. Mayson and various black-and-white developing agents written in ibid. pp. 15–29. Of these compounds, particularly preferred are pyrazolidones such as 1-phenyl-3-pyrazolidone, p-aminophenols and tetramethyl-p-phenylenediamines.

These development accelerators are used in an amount of preferably from 0.001 to 0.1 g, more preferably from 0.003 to 0.05 g, per liter of the developing solution.

The color developing solutions used in the present invention may contain fluorescent brighteners. Preferred fluorescent brightener compounds are 4,4'-diamino-2,2'-disulfostilbene compounds. The fluorescent brighteners are used in an amount of from 0 to 5 g/liter, preferably from 0.1 to 4 g/liter.

If desired, surfactants such as alkylsulfonic acids, arylsulfonic acids, aliphatic carboxylic acids and aromatic carboxylic acids may be added.

The processing temperature with the color developing solutions in the present invention is from 20° to 50° C., preferably from 30° to 45° C. The processing time is from 20 sec to 5 min, preferably from 30 sec to 3 min 20 sec, and more preferably from 1 to 2 min 30 sec.

It is preferred that processing in the present invention is carried out in a color processing time of 150 sec or shorter. The term "processing time" as used herein refers to a time taken until the top of the photographic material is immersed in the color developing solution and then immersed in a processing solution in the subsequent stage. The time include a time during which the photographic material is moved in the air to transfer it from one stage to another stage.

The time in the air is generally 1 to 30 sec. It is preferred that the time in the air is shorter to conduct rapid processing which is intended by the present invention. Preferably, the time in the air is 15 sec or shorter, particularly 10 sec or shorter.

The effect of the present invention is remarkable when short-time processing is carried out. The processing of 120 sec or shorter is more preferred, and 100 sec or shorter is most preferred.

If desired, the color development bath may be composed of two or more baths. The replenishment of the color developing solution is made from the first bath or the last bath to shorten the development time and to reduce the amount of the replenisher.

The processing method of the present invention can be applied to reversal color development. Black-and-white developing solutions used in the reversal color development are processing solutions called first black-and-white developing solutions used in the reversal development of conventional color photographic materials. Conventional additives contained in the black-and-white developing solutions used in the processing of black-and-white silver halide photographic materials can be contained.

Examples of typical additives include developing agents such as 1-phenyl-3-pyrazolidone, Metol and hydroquinone; preservatives such as sulfites; accelerators comprising an alkali such as sodium hydroxide, sodium carbonate or potassium carbonate; inorganic and organic restrainers such as potassium bromide, 2-methylbenzimidazole and methylbenzthiazole; water softeners such as polyphosphates; and development restrainers comprising a very small amount of an iodide and a mercapto compound.

When processing is carried out with the above developing solutions in an automatic processor, it is preferred that the contact area (opening area) of the developing solution with air is as small as possible. For example, when a value obtained by dividing the opening area ($cm^2$) by the volume ($cm^3$) of the developing solution is referred to as the opening ratio, the opening ratio is preferably 0.01 ($cm^{-1}$) or less, more preferably 0.005 ($cm^{-1}$) or less.

It is preferred that water in an amount corresponding to the amount of water evaporated is added to thereby correct the concentration of the developing solution concentrated by evaporation.

The present invention can be effectively used even when the developing solutions are regenerated and reused.

It is preferred that the color developing solutions are continuously used in the present invention while the replenisher is fed. The replenisher contains the required amounts of ingredients for covering the amounts of the ingredients consumed by development and exhausted with time. Accordingly, the replenisher generally contains slightly larger amounts of the ingredients in comparison with the mother developing solution. Generally, the amounts of ingredients in the replenisher are larger by 10 to 50% by volume than that in the mother solution.

However, since the bromide is dissolved out from the photographic materials by development, it is preferred that the content of the bromide in the replenisher is smaller than that in the mother solution. It is also preferred that the amount of the bromide is reduced with a reduction in the amount of the replenisher. For example, when the replenishment rate is set to 700 ml or less per $m^2$ of the photographic material, the content of the bromide is preferably 0.004 mol/liter or less, and when the replenishment rate is 500 ml or less, the content of the bromide is preferably 0.003 mol or less. When the replenishment rate is to be further reduced, it is preferred that the replenisher is free from the bromide.

The color developing solutions are prepared by dissolving the above-described compounds in water. Water used is preferably soft water. Particularly preferred is distilled water or water having an electrical conductivity of 10 μs/cm or below deionized by an ion exchange resin or a reverse osmosis membrane.

The replenishment rate of the developing solution varies depending on the types of the color photographic materials to be processed, but the replenishment rate is generally 3 liters or less per $m^2$ of the photographic material. The replenishment rate can be reduced to 500 ml or less by decreasing the concentration of bromide ion in the replenisher. When the replenishment rate is reduced, it is preferred that the contact area of the developing solution with air in the processing bath is reduced to thereby prevent the developing solution from evaporating and from being oxidized by air. Further, the replenishment rate can be reduced by providing a means for inhibiting the accumulation of bromide ion in the developing solution.

After color development, the photographic emulsion layers are usually bleached. Bleaching may be carried out simultaneously with fixing (bleaching-fixing). Bleaching and fixing may be separately carried out. After bleaching, a bleaching-fixing treatment may be carried out to expedite processing. Processing may be conducted by using a bleaching-fixing bath composed of two consecutive baths. Fixing may be conducted before bleaching-fixing, or bleaching may be conducted before bleaching-fixing. Bleaching agents include compounds of polyvalent metals such as iron(III), cobalt(III), chromium(VI) and copper(II), peracids, quinones and nitro compounds. Examples of typical bleaching agents include ferricyanides; dichromates; organic complex salts of iron(III) or cobalt(III), for example, complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid or complex salts of citric acid, tartaric acid and malic acid; persulfates; bromates; permanganates; and nitrobenzenes. Of these compounds, iron(III) complex salts of aminopolycarboxylic acids such as ethylenediaminetetraacetato ferrate and persulfates are preferred from the standpoint of rapid processing and the prevention of environmental pollution. Further, the iron (III) complex salts of the aminopolycarboxylic acids are useful for bleaching solutions as well as bleaching-fixing solutions. The pH of the bleaching solutions or the bleaching-fixing solutions is usually from 5.5 to 8. However, a lower pH can be used to conduct rapid processing.

Bleaching accelerators may be optionally contained in the bleaching solutions, the bleaching-fixing solutions and the prebath thereof. Specific examples of useful bleaching accelerators include compounds having a mercapto group or a disulfide bond described in U.S. Pat. No. 3,893,858, West German Patent 1,290,812, JP-A-53-95630 and *Research Disclosure* No. 17129 (July 1978); thiazolidine derivatives described in JP-A-50-140129; thiourea derivatives described in U.S. Pat. No. 3,706,561; iodides described in JP-A-58-16235; polyoxyethylene compounds described in West German Patent 2,748,430; polyamine compounds described in JP-B-45-8836; and bromide ions. Of these compounds, the compounds having a mercapto group or a disulfide bond are preferred from the viewpoint of high accelerating effect. Particularly, the compounds described in U.S. Pat. No. 3,893,858, West German Patent 1,290,812 and JP-A-53-95630 are preferred. Further, compounds described in U.S. Pat. No. 4,552,834 are preferred. These bleaching accelerators may be contained in the photographic materials. These bleaching accelerators are particularly effective when the color photographic materials for photographing are subjected to bleaching-fixing.

Fixing agents include thiosulfates, thiocyanates, thioether compounds, thioureas and many iodides. Generally, thiosulfates are used. Particularly, ammonium thiosulfate is widely used. Examples of preservatives which can be preferably used in the bleaching-fixing solutions include sulfites, bisulfites, sulfinic acids and carbonyl bisulfite adducts.

Rinsing and/or Stabilization

After bleaching and fixing treatments, rinsing and stabilization are carried out. Methods of rinsing and stabilization vary depending on the types and use of the photographic materials. For example, after rinsing, the photographic materials may be directly dried. Before drying, the photographic materials may be treated with a stabilizing solution. The photographic materials may be directly treated with the stabilizing solution and dried without conducting rinsing.

Rinsing solution used in the present invention may be any of tap water, well water, distilled water and deionized water. Conventional compounds such as sodium sulfate and magnesium chloride can be added thereto to enhance the rinsing effect. The pH of the rinsing solution is usually from 5 to 8. However, there is often the case where the rinsing solution is adjusted to make it acidic at a pH of 5 or lower or alkaline at a pH of 8 or higher to thereby accelerate rinsing. Another rinsing accelerating means includes the addition of anionic or cationic surfactants to the rinsing solution. Further, compounds described in *Journal of Antibacterial and Antifungal Agents,* Vol. 11, No. 5, pp. 207–223 (1983) and *Antimicrobial Antifungal Chemistry* written by Hiroshi Horiguchi can be added. Particularly, isothiazoline compounds such as 5-chloro-2-methyl-4-isothiazoline-3-one, triazole derivatives such as benztriazole and active halogen releasing compounds such as sodium dichloroisocyanurate have an excellent effect of preserving water from decaying when water is stored. Further, water softeners such as ethylenediaminetetraacetic acid and nitrilotriacetic acid can be used.

All of the compounds which can be added to the rinsing solution can also be added to the stabilizing solution. Further, compounds having an effect of stabilizing image in addition to the above compounds can be added to the stabilizing solution. Examples thereof include aldehyde compounds such as formalin, ammonium compounds such as ammonium chloride and fluorescent brighteners. The pH of the stabilizing solution is generally from 4 to 8. However, there is sometimes the case a lower pH of from 3 to 5 can be preferably used depending on the types of the photographic materials and purpose.

The present invention is now illustrated in greater detail by reference to the following examples which, however, are not to be construed as limiting the invention in any way.

EXAMPLE 1

0.026 mol of potassium bromide, $5.2\times10^{-4}$ mol of thioether ($HO(CH_2)_2S(CH_2)_2S(CH_2)_2OH$) were dissolved in 2.6 l of a 2% by weight gelatin solution. To the resulting solution kept at 70° C., 1,200 ml of an aqueous solution containing 1.2 mol of silver nitrate and 1,200 ml of an aqueous solution containing 1.11 mol of potassium iodide and 0.09 mol of potassium bromide were added by the double jet process.

After completion of the addition, the temperature of the mixture was lowered to 35° C., and soluble salts thereof were removed by conventional flocculation method. The temperature of the mixture was again raised to 40° C., and 60 g of gelatin was added thereto. The pH of the mixture was adjusted to 6.8.

The resulting tabular silver halide grains had a mean diameter of 1.25 μm, a thickness of 0.17 μm, an average ratio of diameter/thickness of 7.4 and a silver iodide content of 3 mol %. The pAg of the resulting emulsion at 40° C. was 8.4.

The emulsion was divided into 12 portions, and the temperature of the emulsion was raised to 62° C. The sensitizing dyes shown in Table 1 below and potassium iodide (200 mg per mol of AgX) were added thereto, and the sensitizing agents shown in Table 1 below were added thereto. Further, chloroauric acid ($9\times10^{-6}$ mol per mol of AgX) and potassium thiocyanate ($3.2\times10^{-4}$ mol per mol of AgX) were added thereto. Furthermore, sodium salt of 1-(3-sulfophenyl)-5-mercaptotetrazole was added thereto, and chemical ripening was carried out for 30 minutes.

After completion of chemical sensitization, 100 g (containing 0.08 mol of Ag) of each portion of the emulsion was dissolved at 40° C., and the following ingredients (i) to (iv) were added thereto in order to prepare each solution while stirring.

| | | |
|---|---|---|
| (i) | 4-Hydroxy-6-methyl-1,3,3a,7-tetrazaindene 3% aqueous solution | 2 ml |
| (ii) | $C_{17}H_{35}$—O—$(CH_2CH_2O)_{25}$—H 2% aqueous solution | 2.2 ml |

-continued

| | | |
|---|---|---|
| (iii) | Compound (A-1) 2% aqueous solution | 1.6 ml |
| (iv) | Sodium salt of 2,4-dichloro-6-hydroxy-s-triazine 2% aqueous solution | 3 ml |

A coating solution for the surface protective layer was prepared by adding the following ingredients (i) to (v) at 40° C. while stirring.

| | | | |
|---|---|---|---|
| (i) | 14% Aqueous gelatin solution | | 56.8 g |
| (ii) | Fine particles of polymethyl methacrylate (average particle size: 3.0 μm) | | 3.9 g |
| (iii) | Emulsion | | |
| | Gelatin | 10% aqueous solution | 4.24 g |
| | Compound (A-2) | | 10.6 mg |
| | Phenol | 72% aqueous solution | 0.02 ml |
| | Compound (A-3) | | 0.424 g |
| (iv) | Water | | 68.8 ml |
| (v) | Compound (A-4) | 4.3% aqueous solution | 3 ml |

The compounds (A-1) to (A-4) and comparative sensitizing dye SD-1 have the following structural formulas.

Compound (A-1)

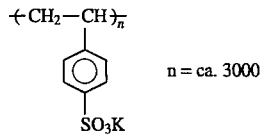

Compound (A-2)

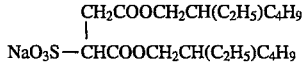

Compound (A-3)

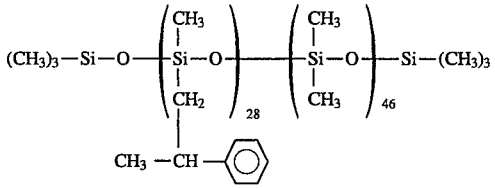

Compound (A-4)

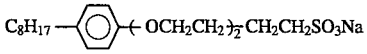

SD-1

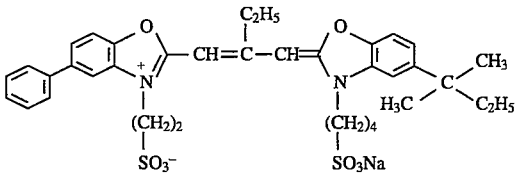

The thus-obtained coating solution for the emulsion layer and the thus-obtained coating solution for the surface protective layer were coated on a polyethylene terephthalate support by means of a co-extrusion method in such an amount as to provide a coating ratio by volume of 103:45. The coating weight of silver was 2.5 g/m$^2$. The samples were exposed to light (1/100 sec) through a yellow filter and an optical wedge by using a sensitometer, and developed with a developing solution RD-III (a product of Fuji Photo Film Co., Ltd.) for automatic processor at 35° C. for 30 sec. The samples were then fixed, rinsed and dried in conventional manner. The photographic sensitivity of the samples was measured. The reciprocal of an exposure amount providing a density of (Fog+0.2) is referred to as sensitivity. The sensitivity in terms of the relative sensitivity is shown in Table 1 when the sensitivity of the sample 1 is referred to as 100. The results are shown in Table 1 below.

TABLE 1

| Sample No. | Sensitizing Agent | Dye I*1 | Dye II*2 | Dye III*3 | Dye IV*4 | Relative sensitivity | Remarks |
|---|---|---|---|---|---|---|---|
| 1 | Sodium Thiosulfate | | | SD-1 | | 100 | Comparison |
| 2 | Sodium Thiosulfate | I-3 | — | — | — | 60 | Comparison |
| 3 | Sodium Thiosulfate | I-3 | II-16 | — | — | 72 | Comparison |
| 4 | Sodium Thiosulfate | I-3 | — | III-14 | — | 103 | Comparison |
| 5 | Sodium Thiosulfate | I-3 | II-16 | III-14 | — | 112 | Invention |
| 6 | Sodium Thiosulfate | I-3 | II-16 | — | IV-1 | 115 | Invention |
| 7 | V-1 | I-3 | II-16 | III-14 | — | 128 | Invention |
| 8 | V-1 | I-8 | II-13 | III-1 | — | 131 | Invention |
| 9 | V-21 | I-4 | II-22 | — | IV-3 | 121 | Invention |
| 10 | V-21 | I-14 | II-27 | III-32 | — | 135 | Invention |
| 11 | V-21 | I-10 | II-6 | — | IV-13 | 119 | Invention |
| 12 | V-21 | I-17 | II-14 | III-44 | — | 123 | Invention |

*1 $5 \times 10^{-3}$ mol/m$^2$
*2 $2.25 \times 10^{-3}$ mol/m$^2$
*3 $1.0 \times 10^{-4}$ mol/m$^2$
*4 $1.0 \times 10^{-4}$ mol/m$^2$ It is apparent from the results shown in Table 1 that high sensitivity can be obtained when the sensitizing dyes of the present invention are used in combination and together with the selenium sensitizing agent of the present invention.

EXAMPLES 2 TO 3

EXAMPLE 2

(Tabular Silver Iodobromide Grains)

Silver Iodobromide Fine Grain Emulsion II-A

To 2.6 liters of a 2.0 wt % gelatin solution containing 0.026 mol of potassium bromide, there were added 1200 ml of an aqueous solution of 1.2 mol of silver nitrate and 1200 ml of an aqueous halide solution containing 1.11 mol of potassium bromide and 0.09 mol of potassium iodide over a period of 15 minutes by the double jet process while stirring. During the addition, the temperature of the gelatin solution was kept at 35° C. The resulting emulsion was washed by conventional flocculation method, and 30 g of gelatin was added thereto. The pH of the emulsion was adjusted to 6.5, and the pAg was adjusted to 8.6. The resulting silver iodobromide fine grains (the content of silver iodide: 7.5 mol %) had a mean grain size of 0.07 μm.

Tabular Silver Bromide Core Emulsion II-B

To 2 liters of a 0.8 wt % gelatin solution containing 0.09 mol of potassium bromide, there were added 30 ml of an aqueous solution of 2.0 mol of silver nitrate and 30 ml of an aqueous solution of 2.0 mol of potassium bromide by the double jet process while stirring. During the addition, the temperature of the gelatin solution was kept at 30° C. After addition, the temperature was raised to 75° C., and 40 g of gelatin was added thereto. Subsequently, and aqueous solution of 1.0 mol of silver nitrate was added thereto to adjust the pBr to 2.55, and 150 g of silver nitrate was added thereto over a period of 60 minutes at such an accelerating flow rate that the flow rate at the time of completion of the addition was 10 times the flow rate at the time of the commencement of the addition, and at the same time, an aqueous solution of potassium bromide was added thereto by the double jet process to adjust the pBr to 2.55.

The emulsion was cooled to 35° C. and washed with water by conventional flocculation method, and 60 g of gelatin was added thereto and dissolved at 40° C. The pH of the emulsion was adjusted to 6.5, and the pAg was adjusted to 8.6. The resulting tabular silver bromide grains had an average diameter (in terms of an average diameter of the corresponding spheres) of 1.4 μm and a grain thickness of 0.2 μm. The resulting grains were monodisperse tabular grains having a coefficient of variation in a grain size (in terms of the diameters of the corresponding spheres) distribution of 15%.

Tabular Silver Iodobromide Emulsion II-C

The emulsion II-B containing silver bromide corresponding to 50 g of silver nitrate was dissolved in 1.1 liters of water. The temperature was kept at 75° C., and the pBr was kept at 1.5. One g of 3,6-dithiaoctane-1,8-diol was added thereto immediately, 100 g (in terms of silver nitrate) of the fine grain emulsion II-A was added to the reaction vessel at a given flow rate over a period of 50 minutes. The resulting tabular grains had an average diameter (in terms of an average diameter of the corresponding spheres) of 2.4 μm and a grain thickness of 0.31 μm.

The emulsion was washed with water by conventional flocculation method. The pH of the emulsion was adjusted to 6.5, and the pAg was adjusted to 8.6.

The resulting emulsion was divided into seven portions. The temperature of the emulsion was raised to 56° C. The sensitizing dyes shown in Table 2 below were added. Sodium salt of 1-(3-sulfophenyl)-5-mercaptotetrazole and sodium thiosulfate were added thereto. Subsequently, chloroauric acid ($1\times10^{-5}$ mol per mol of AgX) and potassium thiocyanate ($6\times10^{-1}$ mol per mol of AgX) were added thereto, and chemical ripening was carried out best. The following compounds were then added thereto. The emulsion layer and the protective layer were coated on a triacetylcellulose film support having an undercoat layer by a co-extrusion method to prepare sample Nos. 13 to 19.

Coupler (B-1)

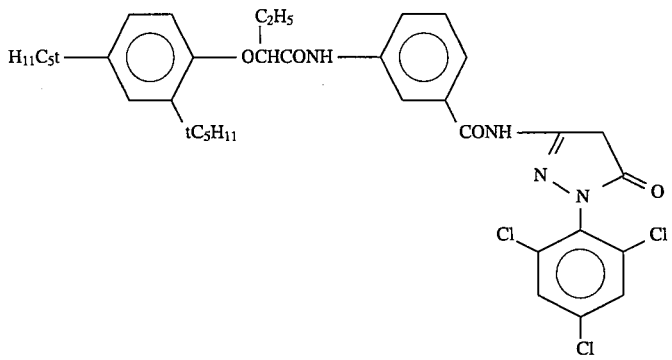

These samples were exposed to light (1/100 sec) for sensitometry and then subjected to color development described hereinafter.

The density of the processed samples was measured through a green filter. The results of photographic performances obtained are shown in Table 2 below. The sensitivity in terms of the relative sensitivity is shown in Table 2 when the sensitivity of the sample 13 is referred to as 100.

TABLE 2

| Sample No. | Dye I*1 | Dye II*2 | Dye III*3 | Dye IV*4 | Relative Sensitivity | Relative Sensitivity After Stored at 50° C. 80% RH for 3 days | Remarks |
|---|---|---|---|---|---|---|---|
| 13 | | SD-1 | | | 100 | 60 | Comparison |
| 14 | I-1 | — | — | — | 62 | 40 | Comparison |
| 15 | I-4 | II-5 | — | — | 68 | 48 | Comparison |
| 16 | I-8 | II-8 | III-3 | — | 134 | 121 | Invention |
| 17 | I-1 | II-16 | III-11 | — | 122 | 109 | Invention |
| 18 | 1-3 | II-18 | III-14 | — | 129 | 112 | Invention |
| 19 | I-16 | II-31 | — | IV-1 | 115 | 105 | Invention |

*1 $5 \times 10^{-3}$ mol/m$^2$
*2 $2.25 \times 10^{-3}$ mol/m$^2$
*3 $1.0 \times 10^{-4}$ mol/m$^2$
*4 $1.0 \times 10^{-4}$ mol/m$^2$ It is apparent from the results shown in Table 2 that when the sensitizing dyes of the present invention are used in combination, sensitivity in the region of green light can be increased and at the same time, a lowering in the sensitivity under high temperature and humidity conditions can be reduced.

EXAMPLE 3

(1) Preparation of Emulsion

Emulsion A-1:

While 1.0 liter of a 0.7 wt % aqueous solution of inert ossein gelatin containing 0.57 mol (per liter of the solution; the same applies hereinbelow) of potassium bromide (solution A) was kept at a temperature of 30° C. with stirring, an aqueous solution of 1.95 mol of potassium bromide (solution B) and an aqueous solution of 1.9 mol of silver nitrate (solution C) were added thereto at a given rate by the double jet process (2.06% of the entire silver nitrate was consumed). Further, 400 ml of a 8 wt % deionized gelatin solution was added thereto, and the temperature was raised to 75° C. An aqueous solution of 1.12 mol of silver nitrate (solution D) was added thereto to adjust the pBr to 2.13 (1.84% of the entire silver nitrate was consumed). An aqueous solution of 14.7N ammonia was added thereto to adjust the pH to 8.3. After physical ripening, 1N nitric acid was added thereto to adjust the pH to 5.5. An aqueous solution of 1.34 mol of potassium bromide (solution E) and the solution D were simultaneously added thereto over a period of 11 minutes (at such an accelerating flow rate that the flow rate at the time of completion of the addition was 2.5 times the flow rate at the time of the commencement of the addition) while the pBr was kept at 1.56 (12.8% of the entire silver nitrate was consumed). The pH was adjusted to 9.3 by adding 1N NaOH. An aqueous solution containing 1.34 mol of potassium bromide and 0.108 mol of potassium iodide (solution F) and the solution D were simultaneously added thereto over a period of 28.5 minutes (at such an accelerating flow rate that the flow rate at time of completion of the addition was 5.5 times the flow rate at the time of the commencement of the addition) while the pBr was kept at 1.56 (67.3% of the entire silver nitrate was consumed). Subsequently, 100 ml of an aqueous solution of 0.14 mol of potassium iodide (solution G) was added thereto over a period of 10 minutes. Ten minutes after completion of the addition, the solution D and an aqueous solution of 1.34 mol of potassium bromide (solution H) were simultaneously added thereto over a period of 10 minutes (at such an accelerating flow rate that the flow rate at the time of completion of the addition was twice the flow rate at the time of the commencement of the addition) while the pBr was kept at 2.42 (16% of the entire silver nitrate was consumed). Desalting was carried out by conventional flocculation method. There were obtained tabular AgBrI grains (silver iodide content: 5 mol %) having a ratio of the average particle diameter/thickness of 6.5 and a mean grain size (in terms of an average diameter of the corresponding spheres) of 1.2 μm.

The resulting emulsion was divided into 6 portions, and the temperature of the emulsion was raised to 56° C. After the sensitizing dyes shown in Table 3 below were added, sodium salt of 1-(3-sulfophenyl)-5-mercaptotetrazole and sodium thiosulfate were added thereto. Subsequently, chloroauric acid ($1.2\times10^{-5}$ mol per mol of Ag) and potassium thiocyanate ($4.0\times10^{-4}$ mol per mol of Ag) were added, and ripening was carried out best. The term "best" as used herein refers to that when exposure to light (1/100 sec) was conducted, the highest sensitivity was obtained. Thus, emulsion Nos. 20 to 25 were obtained.

Preparation of Sample

Each of the resulting emulsion Nos. 20 to 25 was coated on a TAC (cellulose triacetate) base under the following coating conditions to prepare each of sample Nos. 20 to 25.

Coupler (C-1)

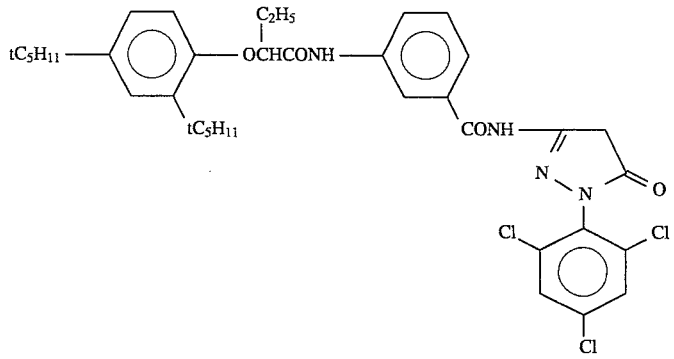

After these samples were left to stand at 40° C. and 70% RH for 14 hours, the samples were exposed to light (1/100 sec) through a gelatin filter YF (a product of Fuji Photo Film Co., Ltd.) and a continuous wedge and subjected to color development described hereinafter.

The density of the processed samples was measured through a green filter. The results obtained are shown in Table 3 below.

The reciprocal of an exposure amount (1x.sec) providing a density of (Fog+0.2) is referred to as the density.

TABLE 3

| Sample No. | Dye I*1 | Dye II*2 | Dye III*3 | Dye IV*4 | Relative Sensitivity | Remarks |
|---|---|---|---|---|---|---|
| 20 | | SD-1 | | | 100 | Comparison |
| 21 | I-3 | — | — | — | 66 | Comparison |
| 22 | I-3 | II-6 | — | — | 70 | Comparison |
| 23 | I-3 | II-16 | III-14 | — | 138 | Invention |
| 24 | I-5 | II-22 | III-32 | — | 119 | Invention |
| 25 | I-17 | II-16 | — | IV-13 | 120 | Invention |

*1 $5\times10^{-3}$ mol/m$^2$
*2 $2.25\times10^{-3}$ mol/m$^2$
*3 $1.0\times10^{-4}$ mol/m$^2$
*4 $1.0\times10^{-4}$ mol/m$^2$ It is apparent from the results shown in Table 3 that even when the tabular AgBrI emulsions are used, the photographic materials having high sensitivity and excellent storage stability can be obtained by the combination of the sensitizing dyes of the present invention.

In Examples 2 and 3, development was carried out at 38° C. under the following conditions by using an automatic processor.

| | |
|---|---|
| Color Development | 3 min 15 sec |
| Bleaching | 1 min |
| Bleaching-Fixing | 3 min 15 sec |
| Rinsing 1 | 40 sec |
| Rinsing 2 | 1 min |
| Stabilization | 40 sec |
| Drying (50° C.) | 1 min 15 sec |

In the above stages, rinsing 1 and 2 were carried out by a countercurrent rinsing system of from 2 to 1.

Each processing solution had the following composition.

The replenishment rate of each processing solution was such that the replenishment rate of the color developing solution was 1200 ml, and that of other processing solution including rinsing was 800 ml, each amount being per m$^2$ of the color photographic material. The amount of the processing solution brought over from the prebath into the rinsing stage was 50 ml per m$^2$ of the color photographic material.

Color Developing Solution

| | Mother Solution | Replenisher |
|---|---|---|
| Diethylenetriaminepentaacetic Acid | 1.0 g | 1.1 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N-Ethyl-N-β-hydroxyethyl-amino)-2-methylaniline sulfate | 4.5 g | 5.0 g |
| Water to make | 1.0 liter | 1.0 liter |
| pH | 10.0 | 10.05 |

Bleaching Solution

Mother solution and replenisher being the same.

| | |
|---|---|
| Ammonium ethylenediaminetetraacetato ferrate dehydrate | 120.0 g |
| Disodium ethylenediaminetetraacetate | 10.0 g |
| Ammonium nitrate | 10.0 g |
| Ammonium bromide | 100.0 g |
| The following Bleaching Accelerator | $5\times10^{-3}$ mol |
| Ammonia Water to make | pH 6.3 |
| Water to make | 1.0 liter |

-continued

Bleaching Accelerator

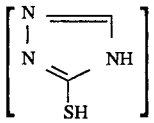

Bleaching-Fixing Solution
Mother solution and replenisher being the same.

| | |
|---|---|
| Ammonium Ethylenediaminetetraacetato ferrate dihydrate | 50.0 g |
| Disodium ethylenediaminetetraacetate | 5.0 g |
| Sodium sulfite | 12.0 g |
| Aqueous solution of ammonium thiosulfate (700 g/liter) | 240 ml |
| Ammonia water to make | pH 7.3 |
| Water to make | 1.0 liter |

Bleaching Accelerator

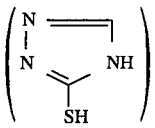

Bleaching-Fixing Solution
Mother solution and replenisher being the same.

| | |
|---|---|
| Ammonium Ethylenediaminetetraacetato ferrate dihydrate | 50.0 g |
| Disodium ethylenediaminetetraacetate | 5.0 g |
| Sodium sulfite | 12.0 g |
| Aqueous solution of ammonium thiosulfate (700 g/liter) | 240 ml |
| Ammonia water to make | pH 7.3 |
| Water to make | 1.0 liter |

Rinsing Solution

Tap water containing calcium ion (32 mg/liter) and magnesium ion (7.3 mg/liter) was passed through a column packed with an H type strongly acidic cation exchange resin and an OH type strongly basic anion exchange resin to reduce the concentration of calcium ion to 1.2 mg/liter and the concentration of magnesium ion to 0.4 mg/liter. Sodium dichloroisocyanurate (20 mg/liter) was added thereto.

Stabilizing Solution
Mother solution and replenisher being the same.

| | |
|---|---|
| Formalin (37% w/v) | 2.0 g |
| Polyoxyethylene p-monononylphenyl ether (average degree of polymerization: 10) | 0.3 g |
| Disodium ethylenediaminetetraacetate | 0.05 g |
| Water to make | 1 liter |
| pH | 5.8 |

Drying

The drying temperature was 50° C.

It will be understood from the above disclosure that according to the present invention there can be obtained a photographic material having increased sensitivity in the region of green light and having an effect of preventing sensitivity from being lowered during storage.

While the invention has been described in detail and with reference to specific embodiments thereof, it is apparent to one skilled in the art that various changes and modifications can be made therein without departing from the spirit and scope of the present invention.

What is claimed is:

1. A silver halide photographic material, wherein the material is spectral sensitized with a combination of at least one compound represented by the following formula (I); at least one compound represented by the following formula (II); and at least one compound selected from the group consisting of compounds represented by the following formulas (III) or (IV):

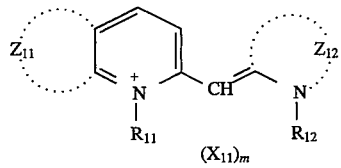

(I)

wherein $R_{11}$ and $R_{12}$ are the same or different and each represents a substituted or unsubstituted alkyl group; $Z_{11}$ represents a substituted or unsubstituted atomic group necessary for forming a benzene ring;

$Z_{12}$ represents a substituted or unsubstituted atomic group necessary for forming a benzothiazole nucleus or a benzoselenazole nucleus;

$X_{11}$ represents a charge-neutralizing counter ion; and m represents 0 or 1, and when an inner salt is formed, m is 0;

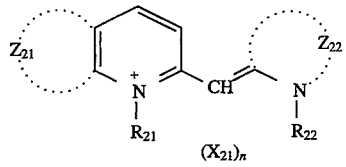

(II)

wherein $R_{21}$, $R_{22}$, $Z_{21}$, $X_{21}$ and n have the same meaning as $R_{11}$, $R_{12}$, $Z_{11}$, $X_{11}$ and m in formula (I), respectively; and $Z_{22}$ represents a substituted or unsubstituted atomic group necessary for forming a benzoxazole nucleus or a naphthoxazole nucleus;

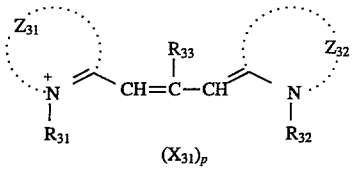

(III)

wherein $R_{31}$ and $R_{32}$ have the same meaning as $R_{11}$ and $R_{12}$ in formula (I);

$R_{33}$ represents a substituted or unsubstituted alkyl group or a substituted or unsubstituted aryl group;

$Z_{31}$ and $Z_{32}$ are the same or different and each represents a substituted or unsubstituted atomic group necessary for forming a benzothiazole nucleus, a benzoxazole nucleus or a naphthoxazole nucleus; and $X_{31}$ and p have the same meaning as $X_{11}$ and m in formula (I), respectively;

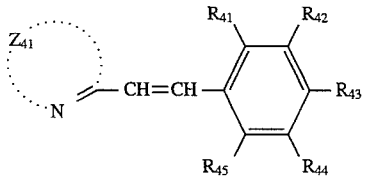

(IV)

wherein $Z_{41}$ represents a substituted or unsubstituted atomic group necessary for forming a five-membered or six-membered nitrogen-containing heterocyclic ring; and $R_{41}$, $R_{42}$, $R_{43}$, $R_{44}$ and $R_{45}$ are the same or different and each represents a substituted amino group, a hydrogen atom, a halogen atom, a hydroxyl group, a substituted or unsubstituted alkyl group, a substituted or unsubstituted alkoxy group, a substituted or unsubstituted aryl group or a group capable of forming a five-membered or six-membered ring by condensed with adjoining substituent groups;

wherein the material is further sensitized with at least one selenium sensitizing agent represented by the following formula (V):

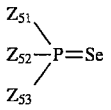

(V)

wherein $Z_{51}$, $Z_{52}$ and $Z_{53}$ are the same or different and each represents a substituted or unsubstituted alkyl group, a substituted or unsubstituted aryl group, a substituted or unsubstituted heterocyclic group, a halogen atom, a hydrogen atom, $—OR_{51}$, $—NR_{52}(R_{53})$, $—SR_{54}$ or $—SeR_{55}$;

in which $R_{51}$, $R_{54}$ and $R_{55}$ each represents a substituted or unsubstituted alkyl group, a substituted or unsubstituted aryl group, a substituted or unsubstituted heterocyclic group, a hydrogen atom or a cation; and $R_{52}$ and $R_{53}$ each represents a substituted or unsubstituted alkyl group, a substituted or unsubstituted aryl group, a substituted or unsubstituted heterocyclic group or a hydrogen atom.

2. The silver halide photographic material as in claim 1, wherein the compounds represented by formula (III) are used in an amount of from 0.5 to 5.0 mol % based on the compounds represented by formula (I).

3. The silver halide photographic material as claimed in claim 1, wherein the selenium sensitizing agent represented by formula (V) is used in an amount of from $1\times10^{-8}$ to $1\times10^{-4}$ mol per mol of silver halide.

4. The silver halide photographic material as claimed in claim 1, wherein the compound represented by formula (II) is used in an amount of from 10 to 90 mol % based on an amount of the compound represented by formula (I).

5. The silver halide photographic material as claimed in claim 1, wherein spectral sensitizing dyes are in a total amount of from $0.5\times10^{-6}$ to $1.0\times10^{-2}$ mol per mol of silver halide.

6. The silver halide photographic material as claimed in claim 1, wherein the compound represented by formula (III) or formula (IV) is used in an amount of from 0.1 to 50 mol % based on total amount of the compounds represented by formulas (I) and (II).

* * * * *